US007303511B2

(12) United States Patent
Bull

(10) Patent No.: US 7,303,511 B2
(45) Date of Patent: Dec. 4, 2007

(54) EXERCISE DEVICE

(76) Inventor: John Bull, 2848 Burnaby Park Loop, Olympia, WA (US) 98501

( * ) Notice: Subject to any disclaimer, the term of this patent is extended or adjusted under 35 U.S.C. 154(b) by 0 days.

(21) Appl. No.: 11/345,639

(22) Filed: Feb. 1, 2006

(65) Prior Publication Data

US 2006/0189454 A1 Aug. 24, 2006

Related U.S. Application Data

(60) Provisional application No. 60/649,276, filed on Feb. 1, 2005.

(51) Int. Cl.
*A63B 69/18* (2006.01)

(52) U.S. Cl. ..... 482/71; 482/70; 482/51; 482/52; 482/62; D21/665; D21/668; D21/766

(58) Field of Classification Search ..... 482/71, 482/70, 52, 51, 62; D21/665, 668, 766
See application file for complete search history.

(56) References Cited

U.S. PATENT DOCUMENTS

| | | | | | |
|---|---|---|---|---|---|
| 3,704,885 | A * | 12/1972 | Raciunas | 482/71 |
| 3,791,645 | A * | 2/1974 | Stelma | 482/71 |
| 4,340,214 | A | 7/1982 | Schutzer | |
| 4,743,014 | A * | 5/1988 | Loane | 482/71 |
| 4,744,558 | A * | 5/1988 | Smirmaul | 482/71 |
| 5,125,880 | A * | 6/1992 | Peters | 482/68 |
| 5,147,257 | A * | 9/1992 | Loane | 482/71 |
| 5,279,532 | A * | 1/1994 | Chen | 482/71 |
| 5,299,996 | A * | 4/1994 | Chi | 482/70 |
| 5,328,427 | A * | 7/1994 | Sleamaker | 482/71 |
| 5,749,811 | A * | 5/1998 | Wilson | 482/71 |
| 5,895,340 | A * | 4/1999 | Keller | 482/71 |
| 5,989,163 | A * | 11/1999 | Rodgers, Jr. | 482/70 |
| 6,302,829 | B1 * | 10/2001 | Schmidt | 482/70 |
| 6,368,254 | B1 * | 4/2002 | Wall | 482/71 |
| 6,482,130 | B1 * | 11/2002 | Pasero et al. | 482/51 |
| 6,514,180 | B1 * | 2/2003 | Rawls | 482/70 |
| 6,569,064 | B1 * | 5/2003 | Loane | 482/71 |
| 6,926,646 | B1 * | 8/2005 | Nguyen | 482/71 |
| 7,090,621 | B2 * | 8/2006 | Loane | 482/71 |
| 7,115,073 | B2 * | 10/2006 | Nizamuddin | 482/51 |
| 2002/0016237 | A1 * | 2/2002 | Schmidt | 482/70 |
| 2002/0082146 | A1 * | 6/2002 | Stearns | 482/54 |
| 2004/0014569 | A1 * | 1/2004 | Loane | 482/70 |
| 2004/0204293 | A1 * | 10/2004 | Andreasen | 482/52 |

FOREIGN PATENT DOCUMENTS

FR 2 569 569 A1 3/1986

* cited by examiner

*Primary Examiner*—Lori Amerson
*Assistant Examiner*—Sundhara M Ganesan
(74) *Attorney, Agent, or Firm*—Seed IP Law Group PLLC

(57) ABSTRACT

An exercise device includes two foot carriage assemblies. The foot carriage assemblies are operable to support a user's feet on a frame and to travel along a generally lateral path of motion. The foot carriages are operable to engage first and second torque tubes, which in turn participate in resisting the lateral movement of the foot carriages. A lateral striding motion on the exercise device may include a simulation of a motion associated with skating and/or skiing.

11 Claims, 21 Drawing Sheets

EXERCISE DEVICE

CROSS-REFERENCE TO RELATED APPLICATION

The present application claims priority from U.S. Provisional Patent Application No. 60/649,276, filed Feb. 1, 2005, the entirety of which applicant incorporates herein by reference.

BACKGROUND OF THE INVENTION

1. Field of the Invention

The present invention generally relates to exercise equipment, and more specifically, to a stationary exercise device for simulating a range of lateral motions, including skiing and skating.

2. Description of the Related Art

Stationary machines designed for exercising allow users to exercise indoors, alleviating obstacles associated with outdoors, such as adverse weather. Additionally, these apparatus allow the user to interact with entertainment media such as a television. However, existing machines have a limited range of motion. Many tend to emulate activities related to walking, climbing and running. Those that do tend to emulate more sophisticated motions suffer from designs that conform the user to a strict posture, precluding the user from experiencing a natural feeling associated with actual sports.

One example is an elliptical motion machine on which the user uses his or her feet, driven by some leg muscles, to pedal in an elliptical range of motion. The position of the user on an elliptical machine generally discourages movement of the upper body. Other machines emulating walking motions typically restrain the user to a specific range of motion that can become monotonous and feel artificial. Factors contributing to the artificial feel of such machines include ranges of motion that generally travel vertically and/or in the fore and aft directions.

Accordingly vast ranges of motion associated with many sports are typically not accommodated indoors. Many such sports require special gear, climate and conditions, such as skiing, which requires snow, mountains and expensive gear, and/or ice-skating, which requires a large area of thickly formed ice. Furthermore, due to the limited range of indoor exercise machines, muscles such as outer thigh muscles, upper body muscles and/or inner thigh muscles are generally not sufficiently worked to gain benefits similar to those gained from performing actual sports such as skiing. Additionally, existing equipment generally is not capable of selectively aiding a portion of the motion to suit the skill or strength level of the user.

There is a need for an indoor exercise device that simulates a range of lateral motions, provides a natural experience associated with outdoor sports, and can selectively aid in portions of the motions to suit varying skills and/or strength levels.

BRIEF SUMMARY OF THE INVENTION

According to one embodiment of the present invention, an exercise device comprises a frame oriented along a longitudinal axis and configured to be supported on a surface, a drive shaft rotatably mounted to the frame along the longitudinal axis, first and second torque tubes, each torque tube mounted on the drive shaft and configured to transfer torque to the drive shaft in at least one direction of rotation, and first and second foot carriage assemblies operable to reciprocate along the frame in the longitudinal direction, the first and second foot carriage assemblies operable to rotate the respective torque tubes upon laterally traveling toward a lateral-most position along the frame.

According to another aspect of the foregoing embodiment, the exercise device may include resistance means for selectively resisting the rotation of the drive shaft.

According to yet another aspect of the foregoing embodiment, the exercise device may include first and second carriage return assemblies associated with the first and second torque tubes, respectively, the first and second carriage return assemblies being operable to promote a return of the first and second foot carriage assemblies, respectively, from the lateral-most position.

According to another embodiment of the present invention, an exercise device comprises a frame defining a longitudinal axis, the frame configured to be supported on a surface, first and second torque tubes, each torque tube rotatably mounted along the longitudinal axis of the frame, first and second foot carriage assemblies operable to move in the longitudinal direction on the frame, at least one of the foot carriage assemblies operable to engage the torque tubes and cause rotation therein upon laterally traveling toward a lateral-most position along the frame, promoting a rotation of the torque tubes, and first and second biasing systems associated with the first and second torque tubes, respectively, and operable to resist the rotation of the torque tubes and the lateral movement of the foot carriage assemblies.

BRIEF DESCRIPTION OF THE SEVERAL VIEWS OF THE DRAWING(S)

DETAILED DESCRIPTION OF THE INVENTION

Figure 1:
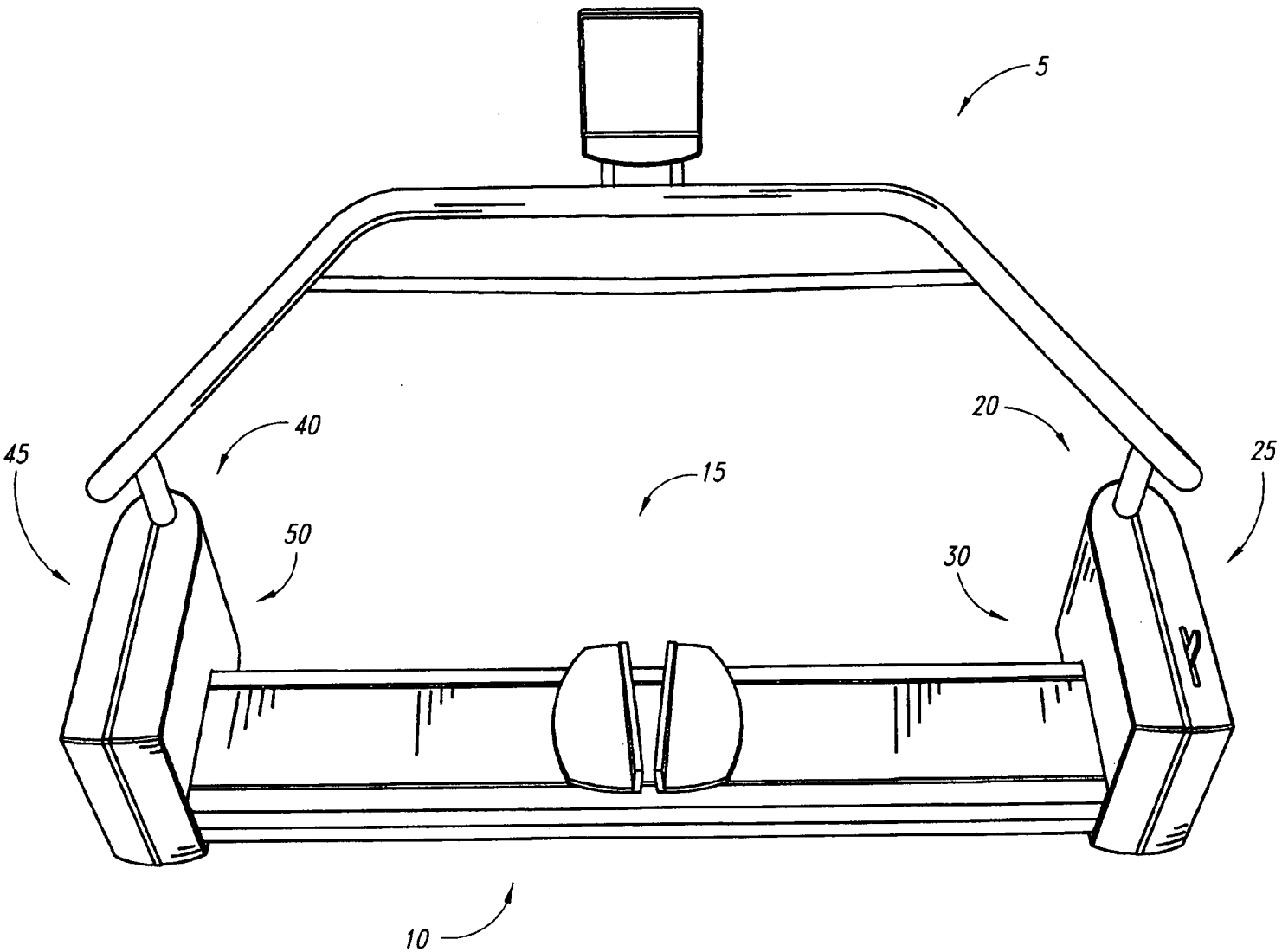
FIG. 1 is a rear perspective view of an exercise device according to one embodiment of the present invention.

FIG. 1 illustrates an exercise device 5 according to one embodiment of the present invention, viewing the device 5 toward a front portion 15 from a rear portion 10 of the device 5. The exercise device 5 comprises first and second end portions 20, 40 respectively having outer sides 25, 45 and inner sides 30, 50.

Figure 2:
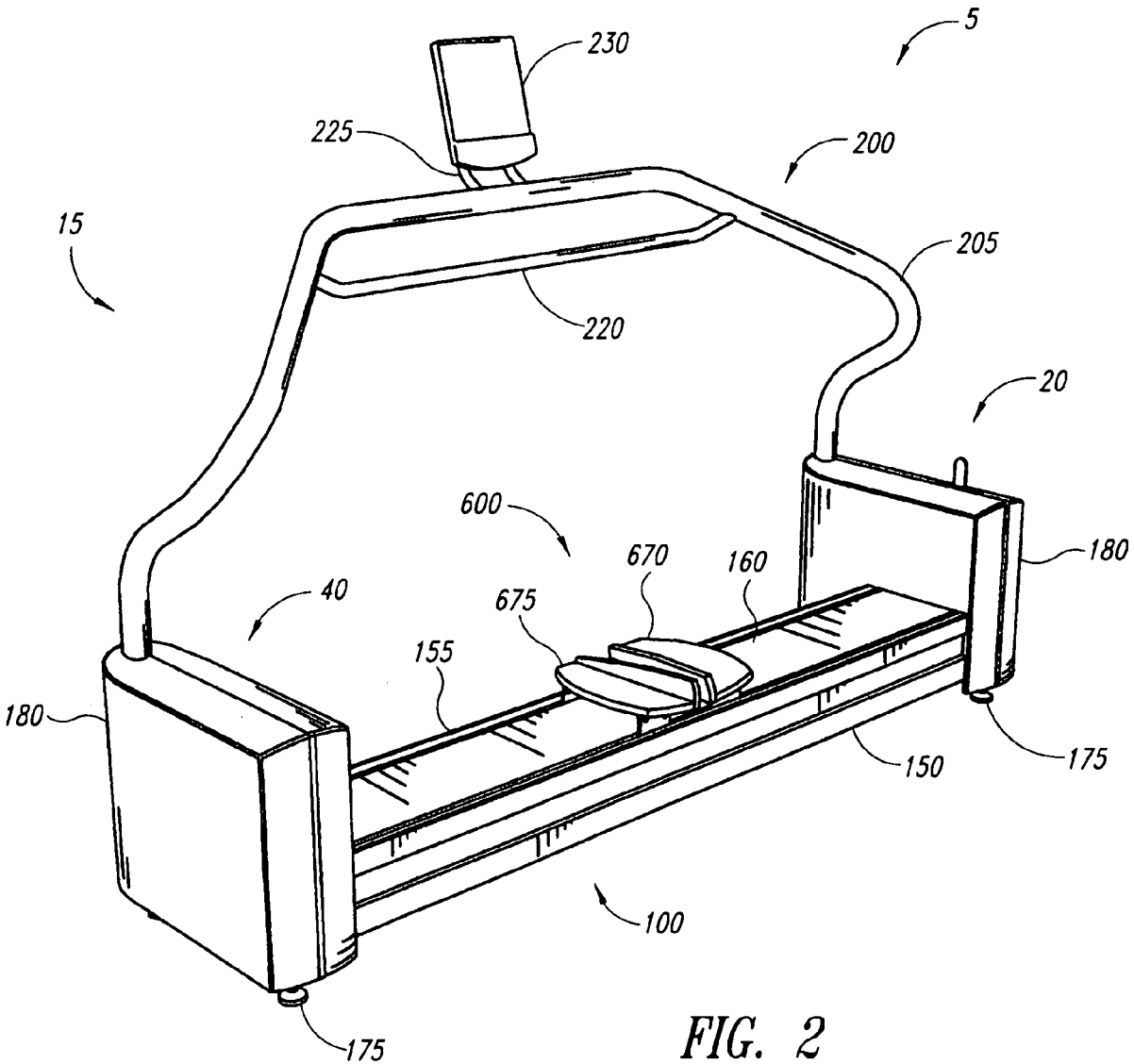
FIG. 2 is a side isometric view of the exercise device of FIG. 1.

As illustrated in FIG. 2, the exercise device 5 includes a carriage frame assembly 100 extending between the end portions 20, 40. The carriage frame assembly 100 includes a first panel 150, a second panel 155 and a third panel 160. The first and second panels 150, 155 may be fabricated from wood, hard plastic, composites such as carbon fiber, metals such as titanium, aluminum, and/or 12 gauge formed steel, or other suitable materials. The third panel 160 may be fabricated from any of the same materials or, alternatively, from a checkered steel plate. Furthermore, each end portion 20, 40 may include at least one end enclosure panel 180 fabricated from plastic, metal, and/or composites or any material that can be molded or otherwise formed to serve as a protective end enclosure.

The exercise device 5 may also include a plurality of mounting devices 175 operable to support the exercise device 5 on a surface or a plurality of raised support members (not shown) to level the device 5. In the illustrated embodiment of FIG. 2, the device 5 includes four mounting devices 175, which are swivel mounts that can raise or lower the device 5 proximate to each mounting device 175 by fastening or unfastening of a threaded protrusion, fixed with respect to the supporting surface, in a threaded receptacle fixed with respect to the end portions 20, 40, to level the device 5.

The exercise device 5 may further comprise a handrail assembly 200 having a main-rail 205 extending between the end portions 20, 40 and laterally extending across the exercise device 5. The handrail assembly 200 may include an optional handrail member 220 laterally extending between and supported by portions of the main-rail 205, toward the front portion 15 of the exercise device 5. The handrail assembly 200 may be fabricated from any suitable material, such as hard plastics, wood, composites such as carbon fiber, and metals such as steel. Furthermore, the handrail assembly 200 may be formed from extrusions, rolls, and/or tubes, or by casting the metals or machining the aforementioned materials. In the illustrated embodiment of FIG. 2, the main-rail 205 is fabricated from 2.5-inch diameter steel tube and the handrail member 220 from 1.25-inch diameter steel tube.

The exercise device 5 may further include an optional panel 230 mounted to the handrail assembly 200 by any suitable means such as hook and loop fasteners, mechanical fasteners, adhesives, and/or mating mechanisms. In the embodiment of FIG. 2, the panel 230 is mounted to the handrail assembly 200 via a panel frame 225 that can be fabricated from, among other suitable materials, plastics, composites, or metals such as 1.0-inch diameter steel tube. In other embodiments the panel 230 may be supported between the main-rail 205 and the handrail member 220. The panel 230 may serve as a platform for resting reading materials or portable devices including portable electronics, such as media players and/or organizers, while a user is exercising on the device 5. The panel 230 may also serve as a housing for means for controlling electromagnetic features of the carriage frame assembly 100 and/or of a resistance assembly 400 as will be discussed in more detail further below.

The exercise device 5 further includes two foot carriage assemblies 600, a portion of which is illustrated in FIG. 2. The foot carriage assemblies 600 includes first and second foot support members 670, 675 adapted to support the user's feet and serve as an interface for the user to exert a force for simulating a range of lateral motions, including skiing and skating. Therefore, the foot support members 670, 675 are movably coupled to the carriage frame assembly 100.

Figure 3:
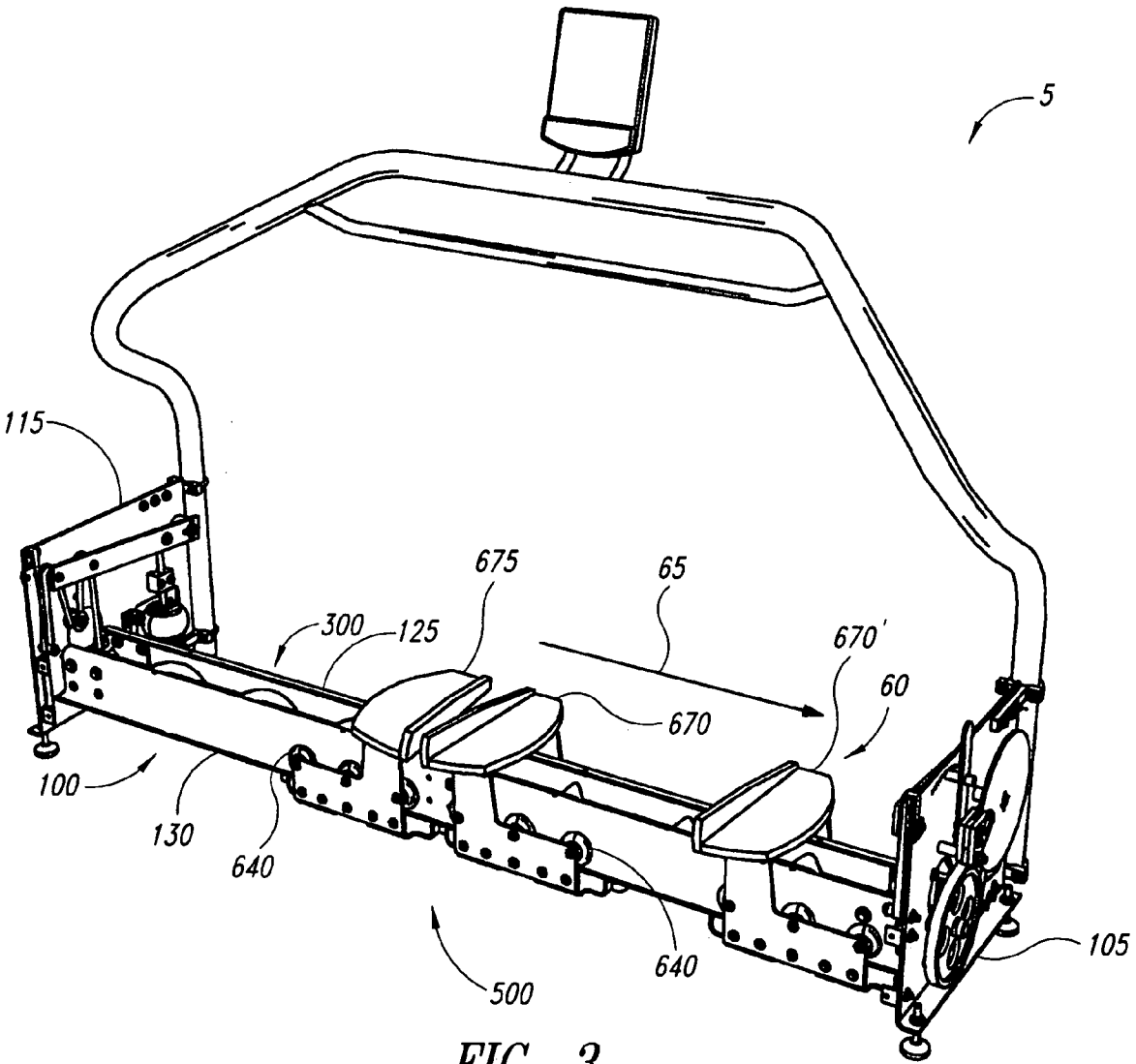
FIG. 3 is an isometric view of the exercise device of FIG. 1 with its housing removed to allow for internal viewing.

FIG. 3 is a partial isometric view of the exercise device 5 with some panels and end enclosures removed, revealing portions of the carriage frame assembly 100, a drive assembly 300, and a carriage return assembly 500.

Figure 4:
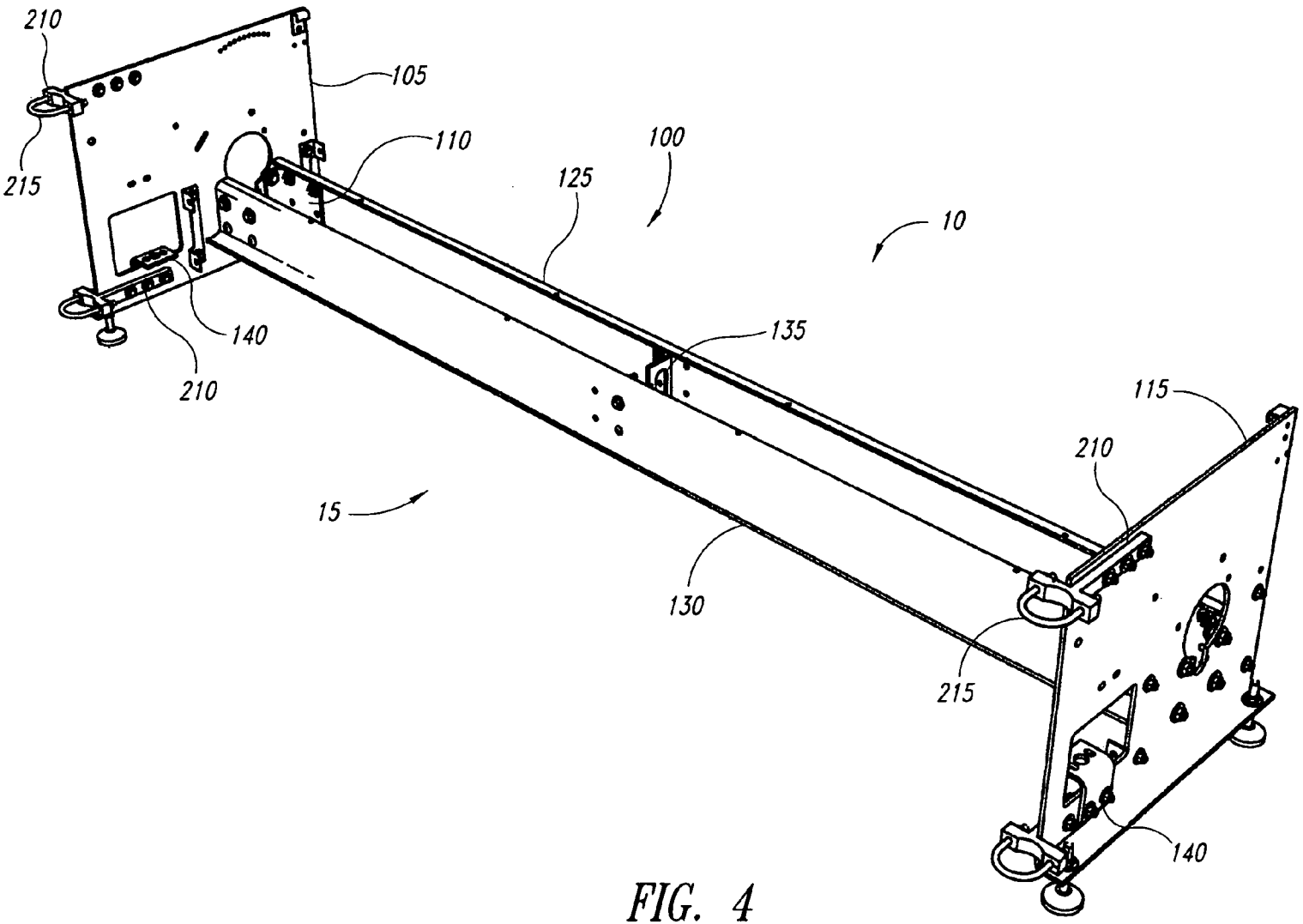
FIG. 4 is an isometric view of a carriage frame assembly from the exercise device of FIG. 1.

FIG. 4 illustrates a portion of the carriage frame assembly 100, viewing the carriage frame assembly 100 toward the rear portion 10 from the front portion 15. As illustrated in FIG. 4, the carriage frame assembly 100 includes first and second end plates 105, 115, and first and second main-rails 125, 130 extending between the end plates 105, 115. The main-rails 125, 130 may be secured in place by any suitable means such as extending through the end plates 105, 115 and locking in place via a mating mechanism. Alternatively, the main-rails 125, 130 may have a return flange that mechanically fastens to the end plates 105, 115. The main-rails 125, 130 and the end plates 105, 115 can be fabricated from any material capable of supporting a weight of a user and any forces induced by the user simulating a range of lateral motions. Suitable materials may include metals such as aluminum, steel and/or titanium, and/or composites such as carbon fiber.

In the illustrated embodiment of FIG. 4 the main-rails 125, 130 are secured to the end plates 105, 115 by first and second angled brackets 110 and mechanical fasteners. The carriage frame assembly 100 may further include an optional third bracket 135 to stabilize the main-rails 125, 130 along their length at a location between the end plates 105, 115. In this embodiment, the main-rails 125, 130, the end plates 105, 115 and the brackets 110, 120, 135 are fabricated from ¼-inch formed steel plates.

FIG. 4 also illustrates two main-rail saddle mounts 210 threadedly receiving a main-rail U-bolt 215 formed to secure the main-rail 205 (FIG. 2) toward the end portions 20, 40 of the exercise device 5. The main-rail saddle mounts 210 are attached to the end plates 105, 115 by mechanical fasteners;

however, they can be attached by any suitable means such as welding. Other embodiments may include only one main-rail saddle mount 210 and main-rail U-bolt 215 per each end plate 105, 115. Alternatively more than two main-rail saddle mounts 210 and main-rail U-bolts 215 can be incorporated per each end plate 105, 115.

Figure 5:
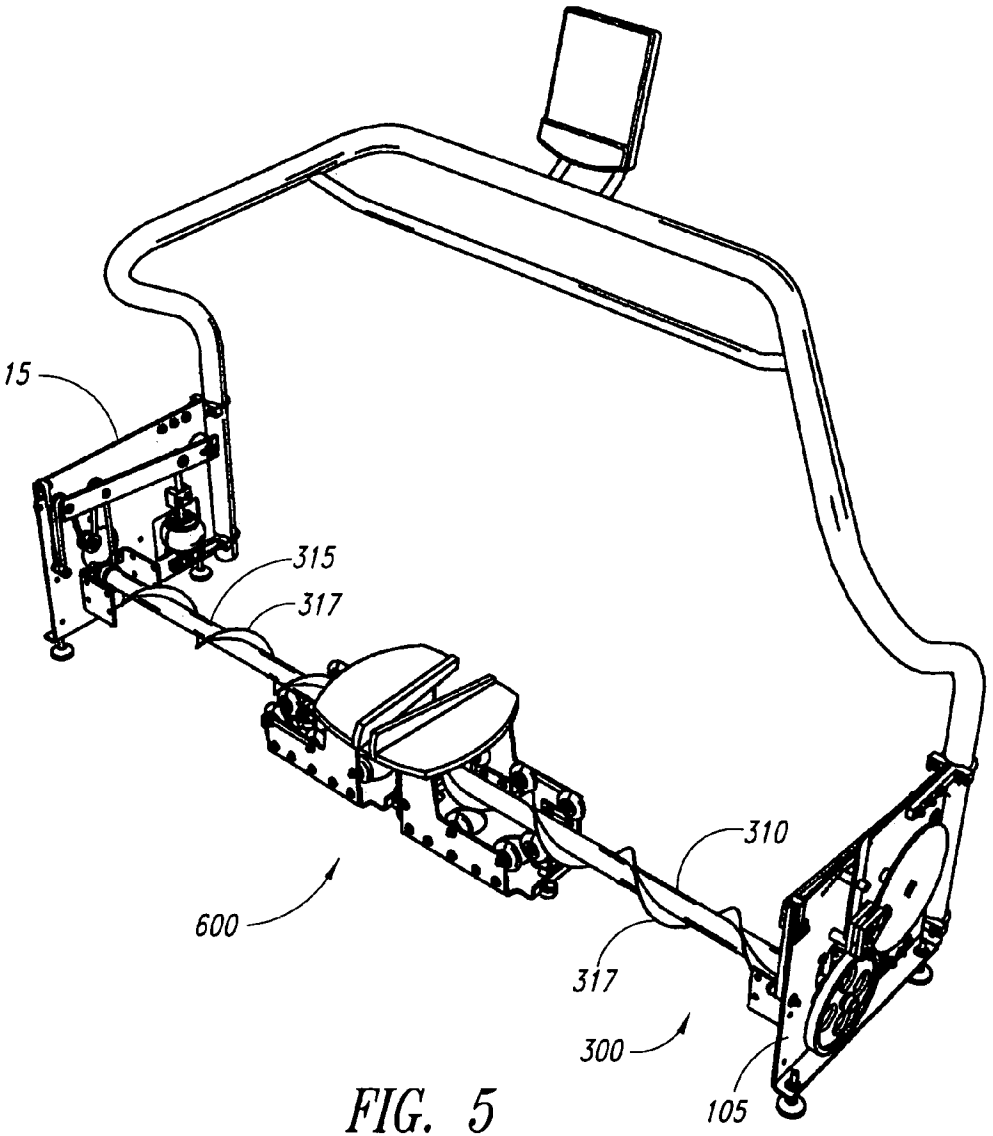
FIG. 5 is an isometric view of a sub-assembly from the exercise device of FIG. 1.

FIG. 5 better illustrates the drive assembly 300 and the foot carriage assemblies 600. The drive assembly 300 may include at least one torque tube interposed between the main rails 125, 130 (FIG. 4) and extending between the end plates 105, 115. In the embodiment illustrated in FIG. 5 the drive assembly 300 of the exercise device 5 includes first and second torque tubes 310, 315, each comprising a helical fin 317 on a surface thereof and extending along at least a portion of a length of the torque tubes 310, 315. The torque tubes may be fabricated from, among other suitable materials, hardened plastics, composites, and/or metals. In the embodiment of FIG. 5, the torque tubes 310, 315 are fabricated from 2.0-inch drawn over mandrel (DOM) tubing. The helical fin 317 may include a constant or variable pitch helix, which may be cut, rolled or formed into the surface of the torque tubes 310, 315, including a rolling, shaping, forming or molding of metal or plastic secured to the circumference of the torque tubes 310, 315.

Figure 6:
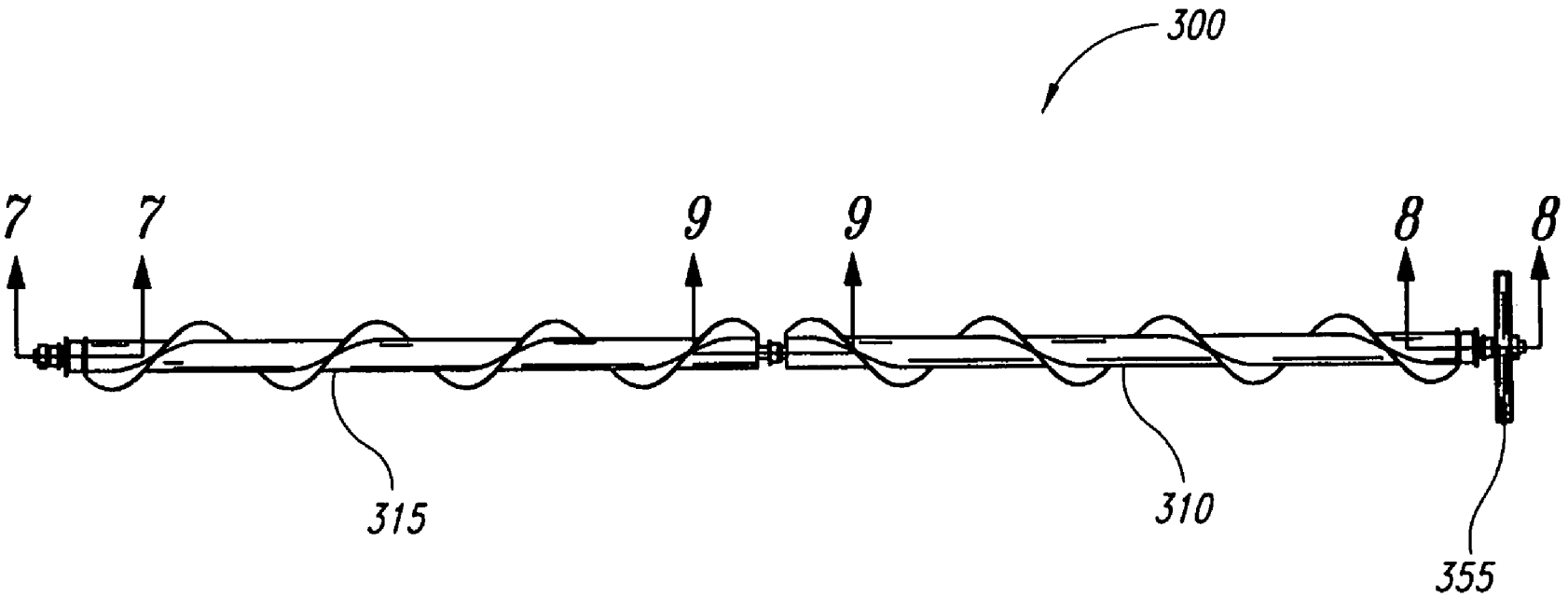
FIG. 6 is a front view of a drive assembly of the exercise device of FIG. 1.

FIG. 6 illustrates a front view of the torque tubes 310, 315 of the drive assembly 300 of this particular embodiment. The torque tubes 310, 315 are mounted on drive shaft 350, freewheeling or overriding drive shaft 350 in one direction and locking or engaging the drive shaft 350 in the opposite direction. The drive shaft 350 mounts to end plates 105, 115 as shown for one embodiment in the cross-sectional views of FIG. 7 and FIG. 8. A drive shaft 350 can extend through the torque tubes 310, 315 in certain embodiments, protruding beyond each end of the torque tubes 310, 315 toward an interface with the end plates 105, 115 (FIG. 5). As illustrated in FIGS. 6 and 8, a drive sheave 355 receives an outer terminal end of the drive shaft 350 that protrudes beyond the end plate 105 (FIG. 5) toward the outer side 25 (FIG. 1) of the first end portion 20. The shaft 350 and sheave 355 share a common axis of rotation 55. Considering another embodiment (FIG. 11) and the preceding description one skilled in the art can appreciate the illustration showing torque tubes 310, 315 mounted about pivot axis 55, supported by end plates 105, 115.

The drive shaft 350 and sheave 355 can be fabricated from any material contributing to bearing loads generated by the user, such as metals and composites. In the illustrated embodiment, the drive shaft is fabricated from ¾-inch hardened steel shaft and the drive sheave 355 from aluminum.

Figure 7:
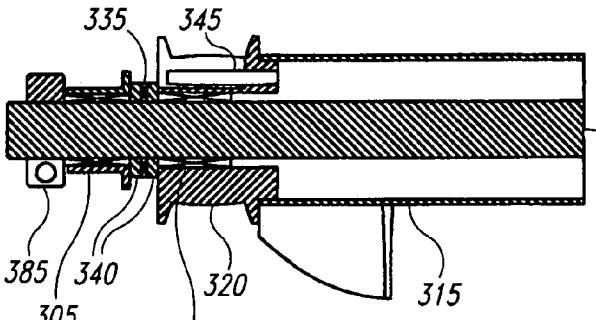
FIG. 7 is a diametric cross-sectional view of a portion of the drive assembly of FIG. 6.
Figure 8:
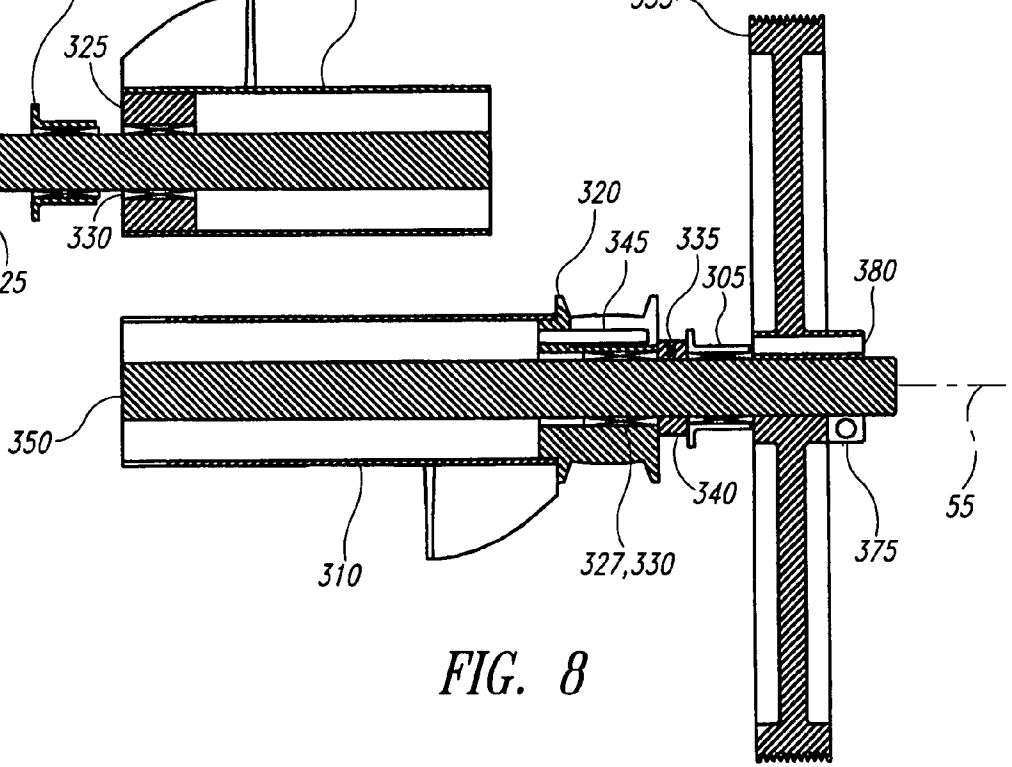
FIG. 8 is a diametric cross-sectional view of another portion of the drive assembly of FIG. 6.

Furthermore, as illustrated in FIGS. 7 and 8, a bushing member 305 may be installed at the interface between the drive shaft 350 and end plates 105, 115 (FIG. 5) to prevent contact between the drive shaft 350 and the end plates 105, 115. The portion of the drive shaft 350 between the outer terminal ends of the torque tubes 310, 315 and the inner side 30, 50 (FIG. 1) of the end plates 105, 115 may be encircled by a torque tube pulley 320 to promote a rotation of the torque tubes 310, 315 when combined with components such as a belt of the carriage return assembly 500 as will be discussed further below. Additionally, the pulley 320 may include a spring pin 345 for hooking to a loop in a belt. The drive assembly 300 may also include a drive shaft one-way clutch 330 Interposed between the pulleys 320 and the drive shaft 350. The one-way clutch 330 may comprise a drive shaft bushing 327 for added axial support on the drive shaft 350.

The bushing member 305 can be any bushing, flanged or unflanged, such as SPYRAFLOW™ part number BFM-75-B self-aligning bushing, preferably flanged in the illustrated embodiment. The torque tube pulley 320 can also be fabricated from suitable material for supporting loads associated with operating the exercise device 5, such as steel. The one-way clutch 330 can be similar to those available from TORRINGTON™, such as part number RCB-121616. The drive shaft bushing 327, if incorporated, can be fabricated from any metal, composite, or plastic, such as a bronze bushing.

Optional torque tube thrust washers 340, similar to TORRINGTON™ part number TRE-1220 can be interposed toward each outer end of the torque tubes 310, 315, between the bushing 305 and the pulley 320, preventing contact between the bushing 305 and the pulley 320. Additionally, a torque tube thrust bearing 335, such as TORRINGTON™ part number NTA-1220 thrust needle roller bearing, can be interposed between the washers 340. The thrust bearing 335 can reduce friction between torque tubes 310, 315 and bushing 305.

First and second drive shaft collars 375, 385 may be installed toward outer terminal ends of the torque tubes 310, 315, securing the drive shaft 350 and preventing axial displacement of the shaft 350, for example by constraining the drive assembly 300 between the bushing members 305. As shown in FIG. 8, a pin 380 made from high strength material such as metals including steel can be driven through the first drive shaft collar 375 and the drive sheave 355, coinciding rotations of the drive shaft 350 and the drive sheave 355.

Figure 9:
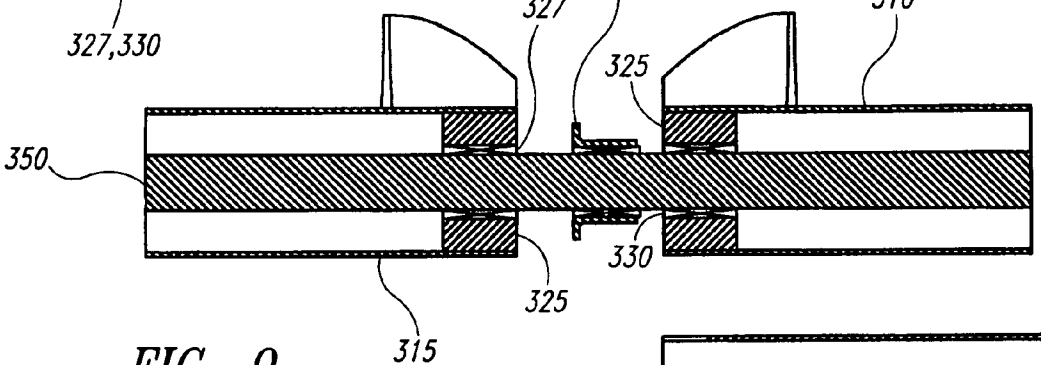
FIG. 9 is a diametric cross-sectional view of yet another portion of the drive assembly of FIG. 6.

Referring to FIG. 9, which is a cross-sectional view of the drive shaft 350 between inner/medial terminal ends of the torque tubes 310, 315. The torque tubes 310, 315 are mounted on the drive shaft 350. Another bushing member 305 can be installed on the drive shaft between the inner terminal ends of the torque tubes 310, 315, preventing contact between the drive shaft 350 and boundaries of an access 137 (FIG. 10) provided on the third bracket 135. Additionally, a torque tube bearing and clutch journal 325 may be incorporated toward the inner terminal ends of the torque tubes 310, 315, encircling the drive shaft 350. The bearing and clutch journal 325 may include a one-way clutch 330 and drive shaft bushing 327 similar to that of the outer ends of the drive shaft as described above.

Figure 10:
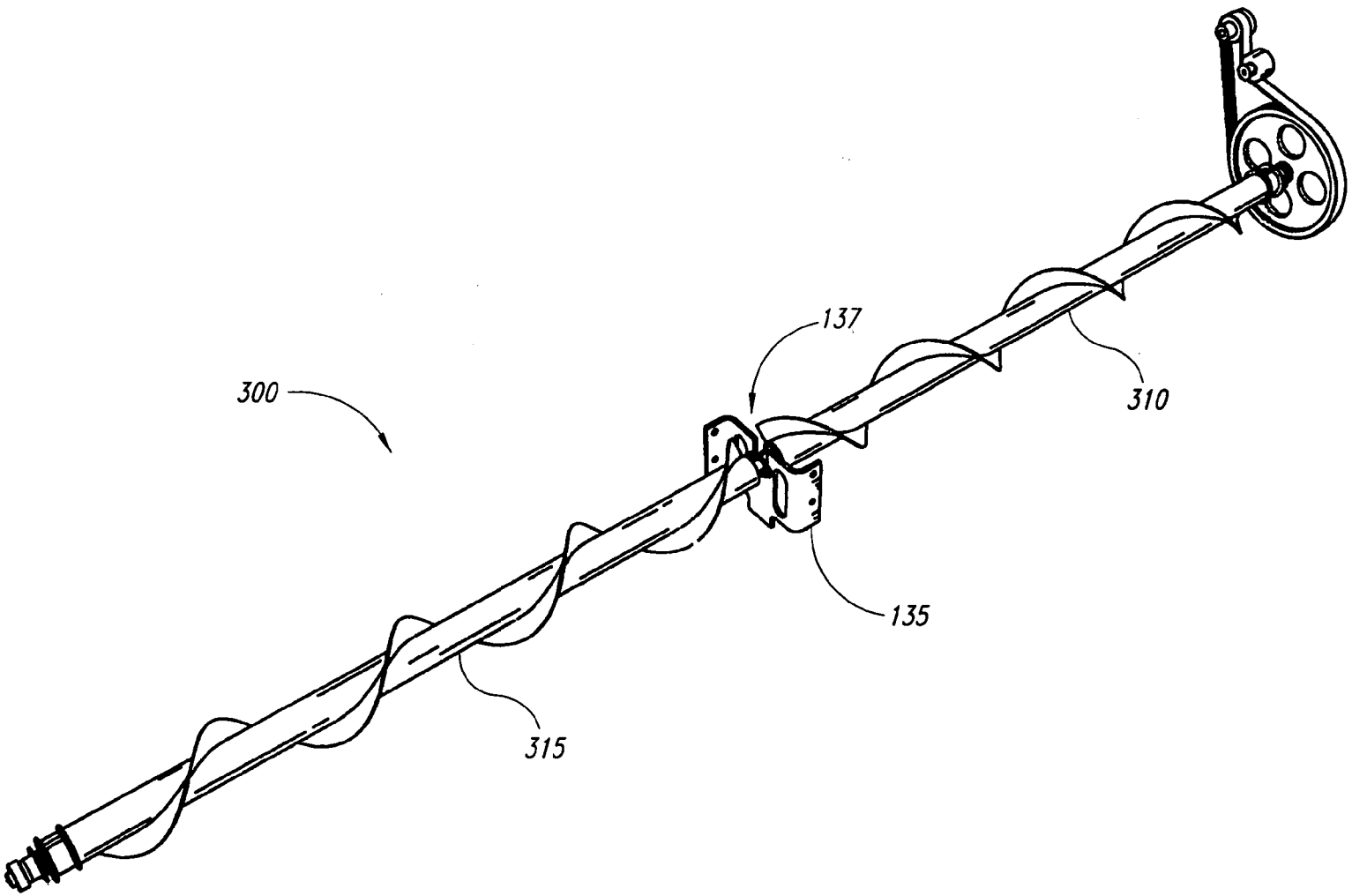
FIG. 10 is an isometric view of the drive assembly of FIG. 6.

As illustrated in FIG. 10, the third bracket 135 may be adapted to allow the drive shaft 350 extend therethrough. As discussed in conjunction with FIG. 4, the third bracket 135 may further stabilize the main rails 125, 130. The access 137 can be provided in the third bracket 135 to accommodate the drive shaft 350.

Figure 11:
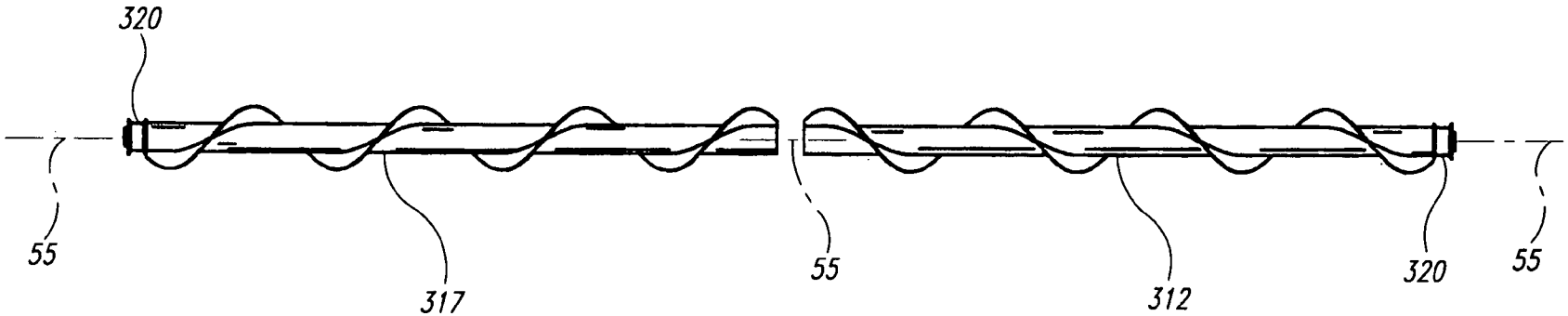
FIG. 11 is a front exploded view of a drive assembly of an exercise device according to another embodiment of the present invention.

It is understood that the drive assembly may not incorporate all the aforementioned components. For example, as shown in FIG. 11, instead of torque tubes 310, 315, torque shafts 312, 317 my be formed of a unitary body of material coupled to pulleys 320 toward the outer/lateral terminal ends of the torque shafts 312, 317, precluding a need for the drive shaft 350 extending between the two torque tubes 310, 315. Furthermore, the bushing 305, between the inner terminal ends of the torque shafts 312, 317 may be precluded. An individual of ordinary skill in the art having reviewed this disclosure will appreciate these and other modifications that can be made to the exercise device 5 and/or the drive assembly 300 without deviating from the spirit of the invention.

Figure 12:
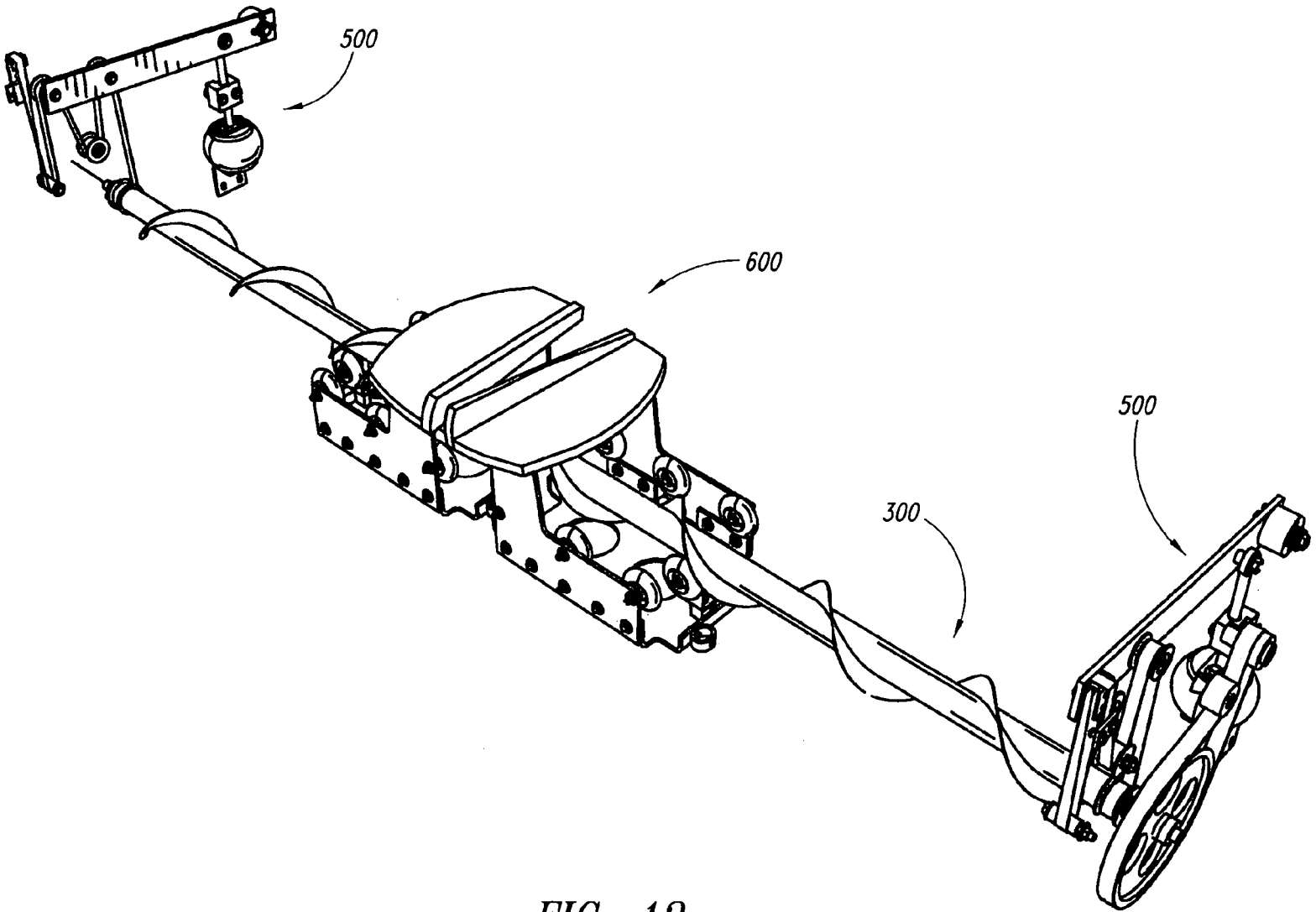
FIG. 12 is an isometric view of another sub-assembly from the exercise device of FIG. 1.

FIG. 12 illustrates an interaction of the drive assembly 300 with the foot carriage assemblies 600 and the carriage return assembly 500. Each of which will be described in turn.

Figure 13:
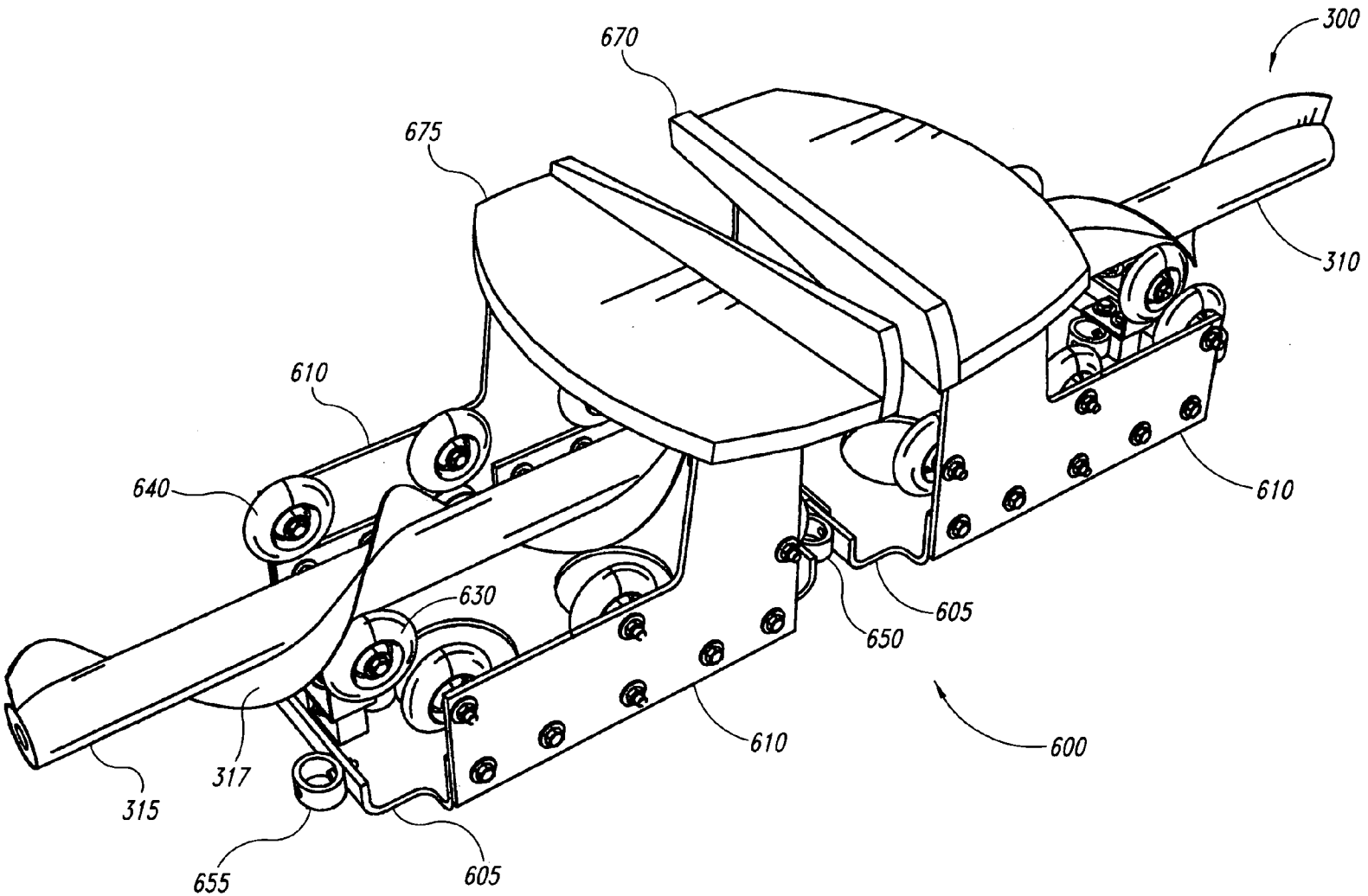
FIG. 13 is an isometric view of a portion of the drive assembly and of the first and second foot carriage assemblies of the exercise device of FIG. 1.

FIG. 13 is a close-up view, illustrating an interaction between the drive assembly 300 and the foot carriage assemblies 600 according to an embodiment of the present invention. Carriage side plates 610 on at least one end/side of the foot support members 670, 675, support the first and second foot support members 670, 675 via any suitable securing means such as a foot support bracket 665 illustrated in FIG. 14. In the embodiment illustrated in FIG. 13, the foot support members 670, 675 are each supported on two sides by carriage side plates 610. Each side plate 610 also secures at least one upper carriage wheel 640 and a side of a carriage tray 605.

In this embodiment, each side plate 610 supports a plurality of upper carriage wheels 640. When the foot carriage assemblies 600 and the carriage frame assembly 100 are assembled, the upper carriage wheels 640 are rotatably positioned on a first surface of a flange of at least one of the main-rails 125, 130 as shown in FIG. 3. The upper carriage wheels 640 promote lateral translation of the foot carriage assemblies 600 while supporting the foot carriage assemblies 600 against the main-rails 125, 130.

The carriage side plates 610 and carriage trays 605 may be fabricated from any material with sufficient strength to withstand forces exerted by the user on the foot support members 670, 675, such as composites and metals. In the embodiment shown, the plates 610 and trays 605 are fabricated from ¼-inch aluminum and ¼-inch formed aluminum, respectively. The upper carriage wheels 640 can be any spherical or cylindrical shape and of any material to resist forces exerted by the user, such as plastics, composites, and/or natural or synthetic rubbers. In the illustrated embodiment, the wheels are in-line skating wheels, which are well known and widely available.

The carriage trays 605 each may include at least one optional carriage bumper 650 and at least one optional end plate carriage bumper 655. The carriage bumper 650 can prevent the foot support members 670, 675 from bumping into one another. The end plate carriage bumper 655 can mitigate impact with the end plates 105, 115 (FIG. 4) in the event the user drives the foot support members 670, 675 toward the end portions 20, 40 (FIG. 1) beyond their intended design limit.

Figure 14:
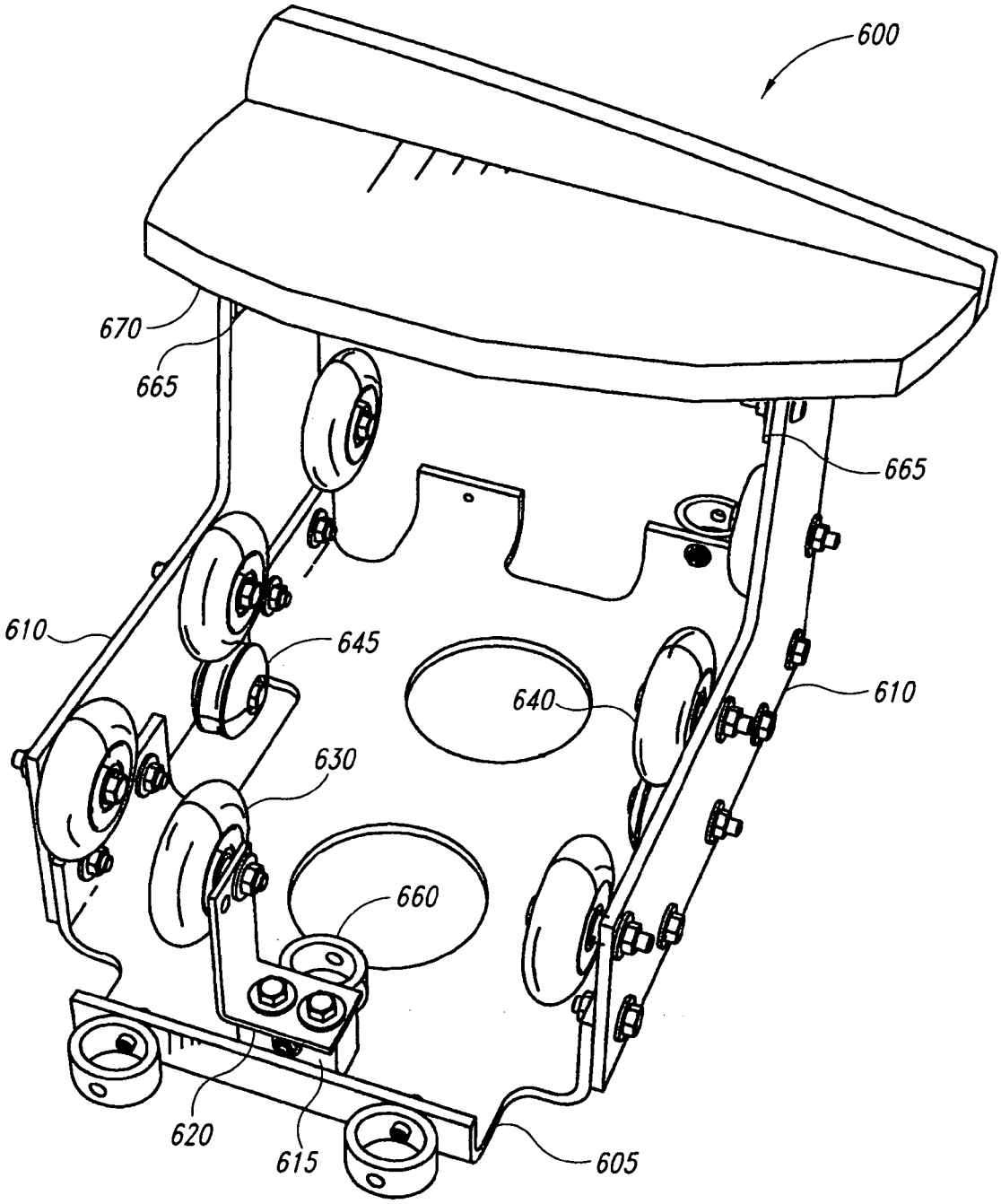
FIG. 14 is an isometric view of a first foot carriage assembly of the exercise device of FIG. 1.
Figure 15:
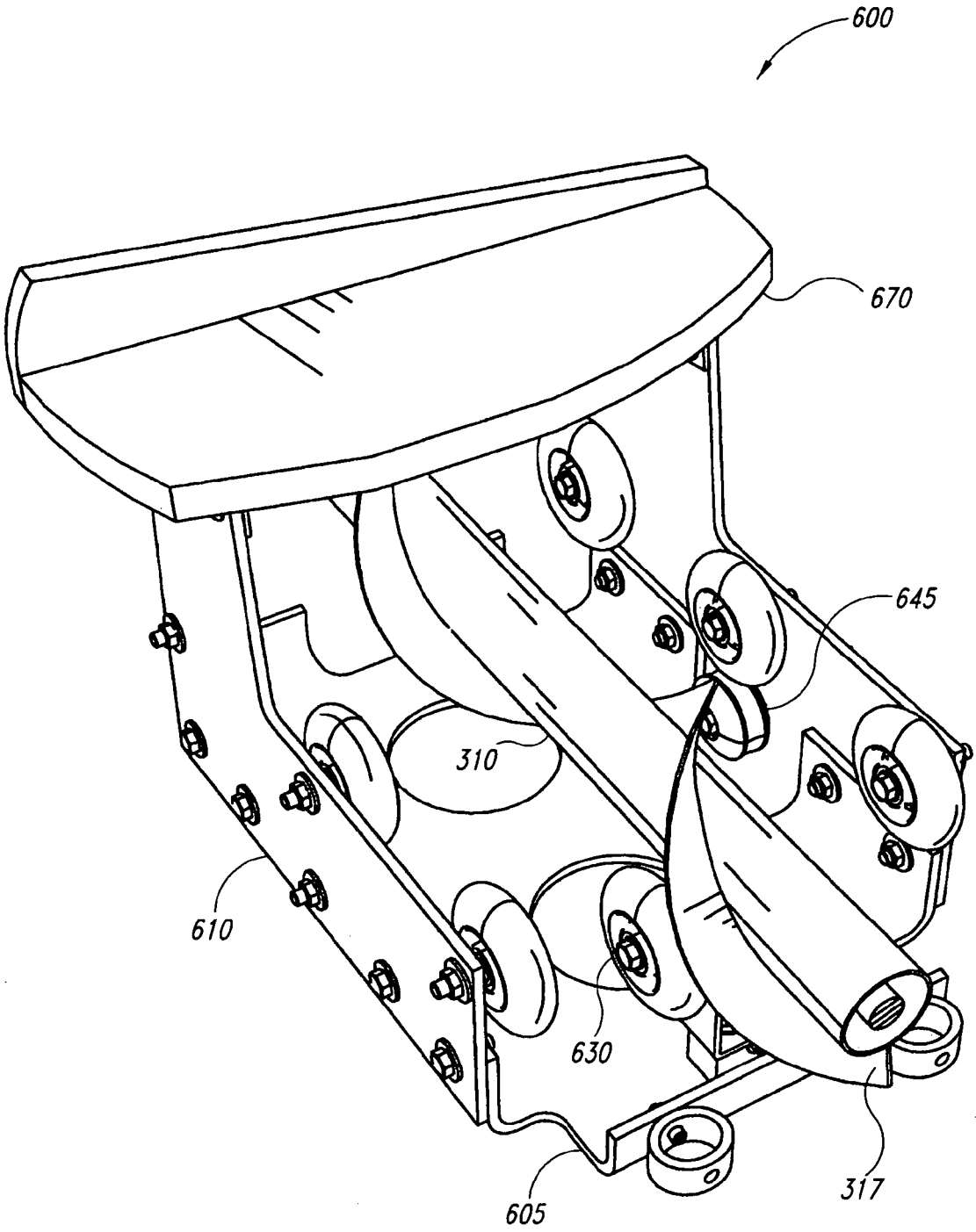
FIG. 15 is an isometric view of a portion of the drive assembly and of the first foot carriage assembly of the exercise device of FIG. 1.

As further illustrated in FIG. 14, the carriage trays 605 may each provide support for at least one torque tube drive wheel 630. In the illustrated embodiment, the support for the drive wheel 630 includes a drive wheel bracket mount 615 supporting a drive wheel bracket 620, which in turn rotatably mounts the drive wheel 630. As illustrated in FIGS. 13 and 15, the torque tube drive wheels 630 drivably engage a first surface of the helical fin 317 of the torque tubes 310, 315, smoothly transferring energy between the lateral translation of the foot carriage assemblies 600 and rotation of the torque tubes 310, 315. Referring to FIG. 14, the drive wheel bracket mount 615 may also secure a inner carriage bumper 660 to contact the third bracket 135 (FIG. 4) to prevent the foot support members 670, 675 of one side from breaching a designed translation range and entering the range of the other side.

The bracket mount 615 and bracket 620 can be fabricated from any suitable material such as plastics, metals and/or composites. In the illustrated embodiment, the bracket mount 615 is fabricated from aluminum and the bracket 620 from 10-gauge steel. Furthermore, the drive wheel 630 can be procured similar to the upper carriage wheels 640, for example by using in-line skating wheels.

The inner carriage bumper 660 may be excluded from embodiments in which lateral translation of both foot support members 670, 675 across an entire length of both torque tubes 310, 315 is desired. Examples may include an embodiment in which the user may desire to simulate a lateral motion similar to parallel skiing, translating both foot support members 670, 675 in close proximity to one another, from one end portion 20 (FIG. 1) to the other end portion 40.

As illustrated in FIGS. 14 and 15, the foot carriage assemblies 600 may further include at least one optional lower carriage wheel 645 rotatably mounted to the carriage trays 605 and/or the carriage side plates 610. The lower carriage wheels 645 may provide additional support against non-lateral displacement of the foot carriage assemblies 600 by engaging a second surface of the flange of at least one of the main-rails 125, 130 (FIG. 4). The lower carriage wheels 645 may be fabricated from material similar to that for the upper carriage wheels and/or from skateboard wheels or any other material or shape that can prevent the non-lateral displacement of the foot carriage assemblies 600 by engaging the flange of the main-rails 125, 130.

Accordingly, a lateral force exerted by the user on the foot support members 670, 675 will tend to rotatably glide the drive wheel 630 along the first surface of the helical fin 317, causing the torque tube 310, 315 to rotate. However, the above details are provided only in way of an example and one of ordinary skill in the art will appreciate that details of the foot carriage assemblies 600 may vary.

Figure 16:
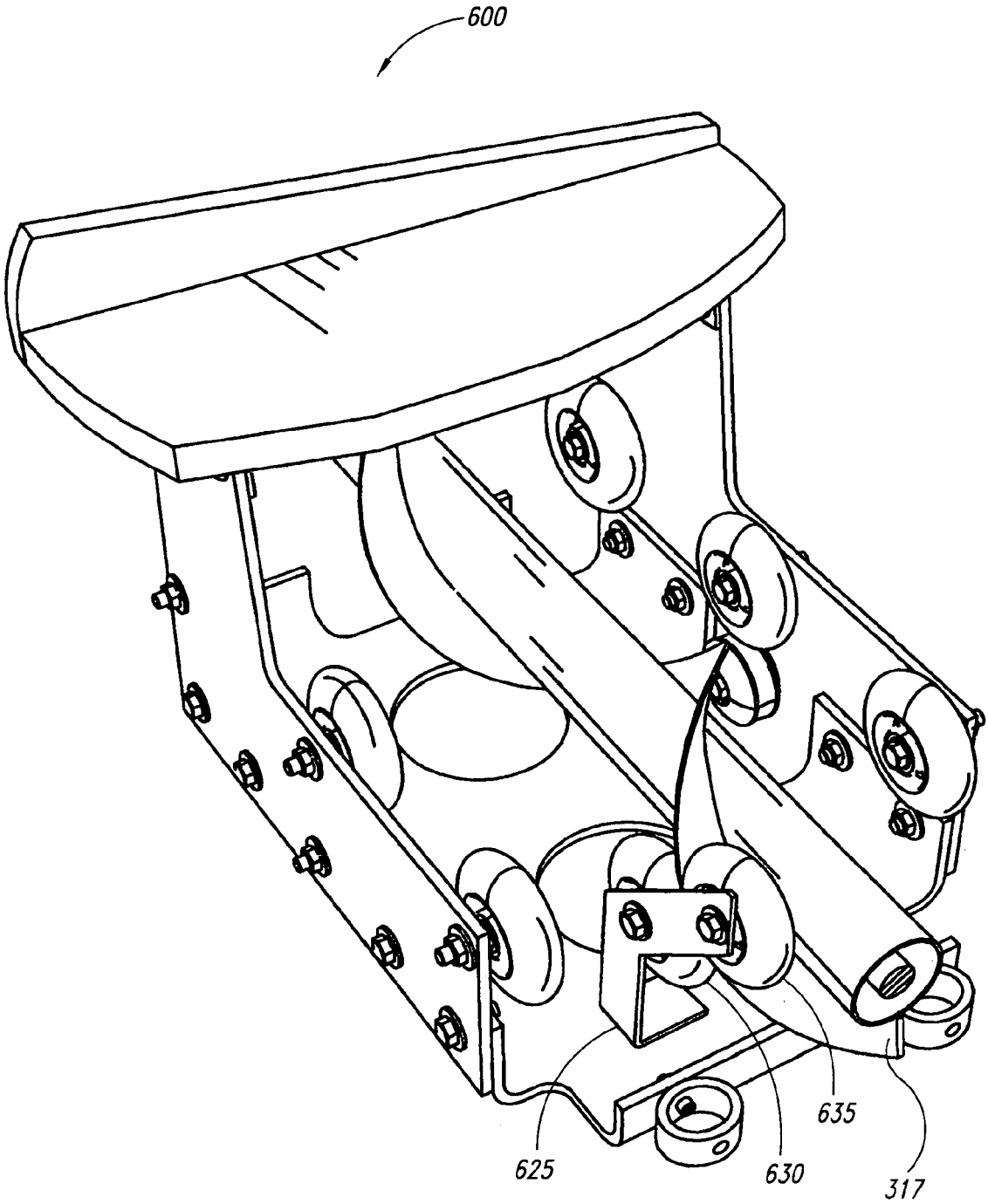
FIG. 16 is an isometric view of a portion of the drive assembly and of a first foot carriage of an exercise device according to yet another embodiment of the present invention.

For example, FIG. 16 illustrates another embodiment of a foot carriage assembly 600 comprising a support bracket 625 operable to support the torque tube drive wheel 630 and a torque tube return wheel 635 rotatably positioned on a second surface of the helical fin 317, opposing the first surface of the helical fin 317 upon which the drive wheel 630 rotatably glides. The return wheel 635 may promote maintaining a contact between the drive wheel 630 and the helical fin 317, further promoting a smooth lateral translation of the foot carriage assemblies 600. An individual of ordinary skill in the art having reviewed this disclosure will appreciate this and other modifications that can be made to the exercise device 5 and/or the foot carriage assemblies 600 without deviating from the spirit of the invention.

Figure 17:
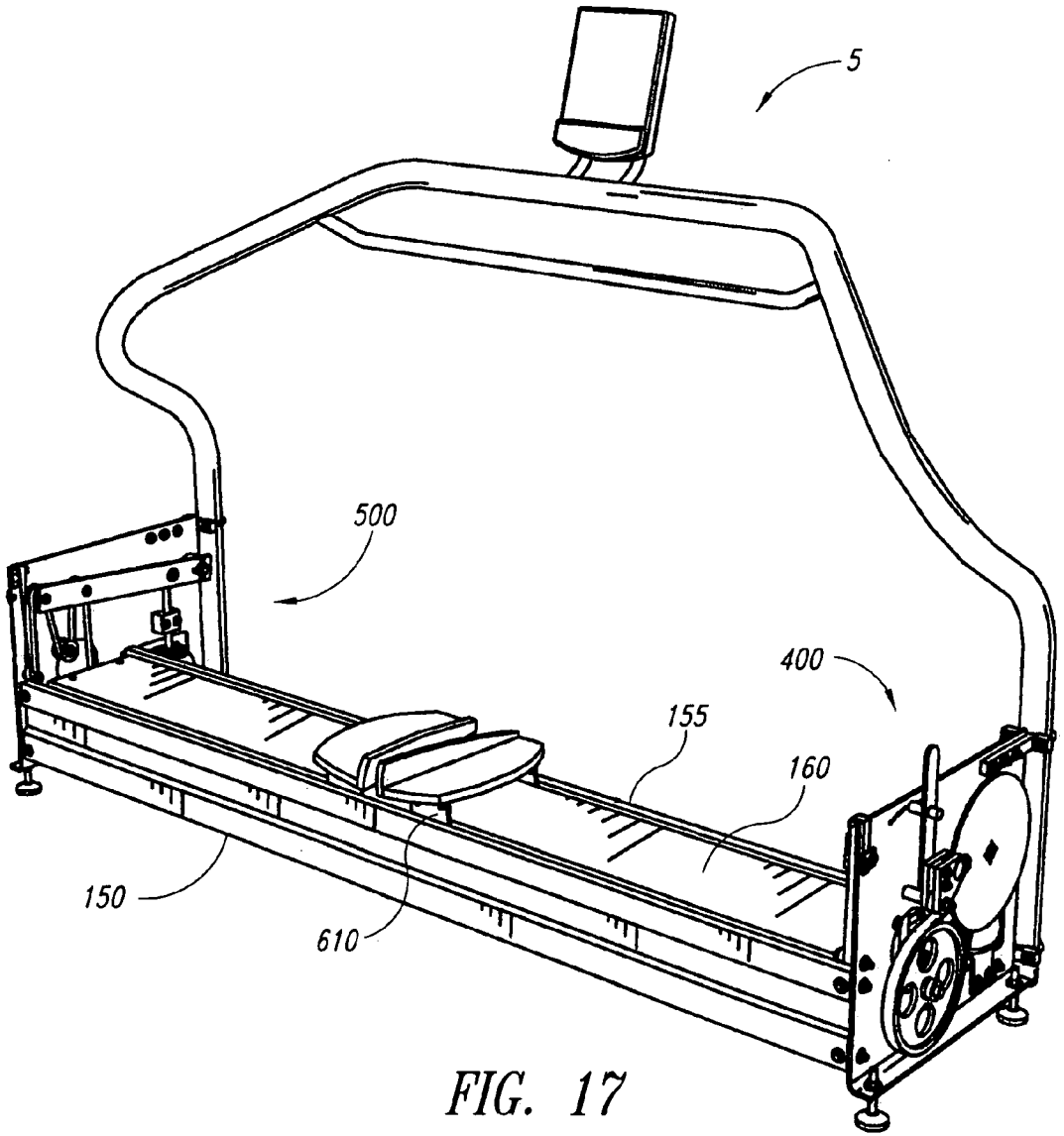
FIG. 17 is an isometric view of the exercise device of FIG. 1 with the end housings removed.

As illustrated in FIG. 17, the panels 150, 155, 160 of the carriage frame assembly 100 are adapted to allow the side plates 610 of the foot carriage assemblies 600 to extend beyond the panel 160 and interact with the main rails 125, 130 (FIG. 4) as discussed above. FIG. 17 also reveals portions of the carriage return assembly 500 and a resistance assembly 400, an operation and components of which according to one embodiment of the present invention will now be discussed in turn.

Figure 18:
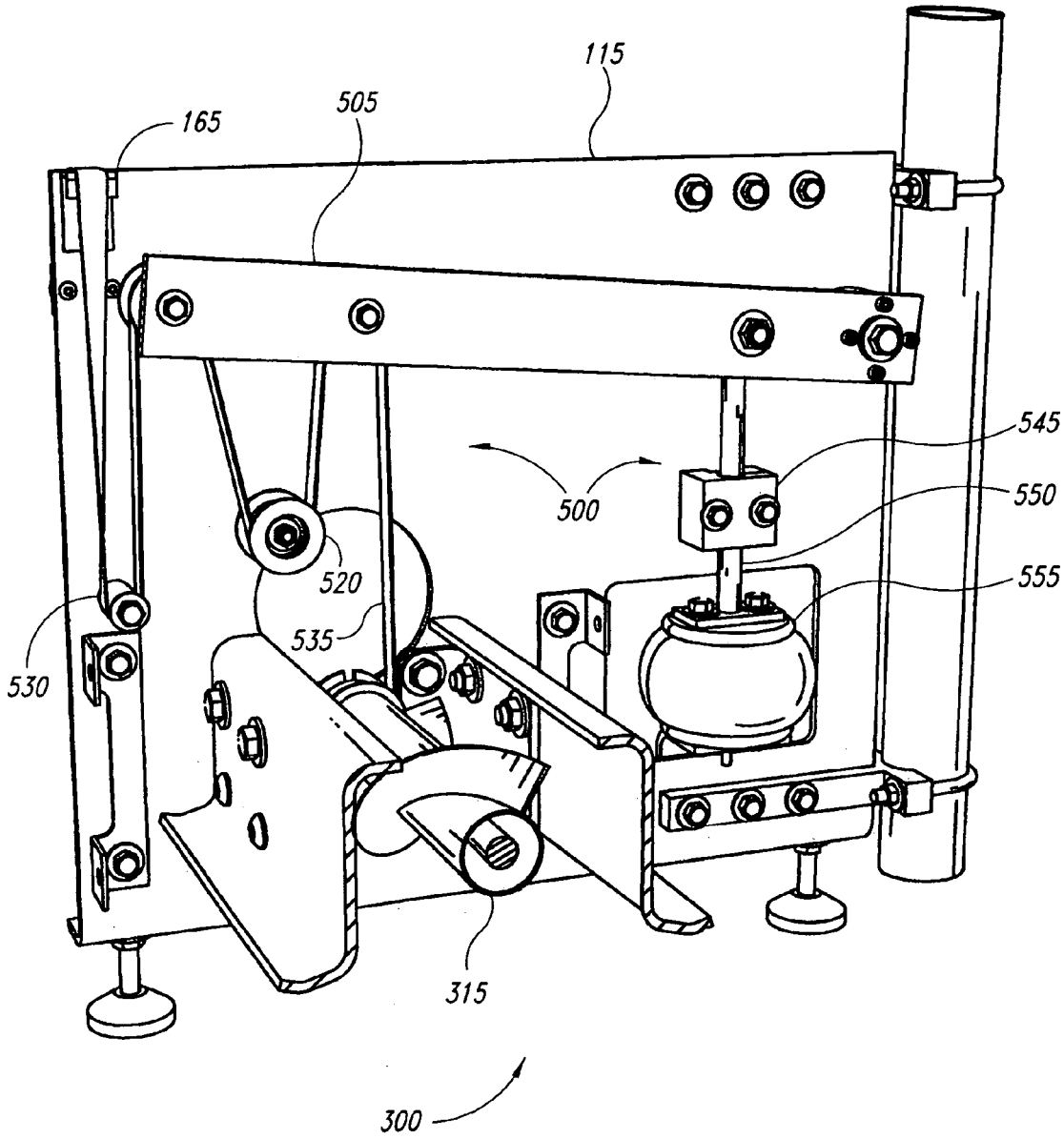
FIG. 18 is an isometric view of an end plate assembly and the first and second main-rails of the exercise device of FIG. 1.

The exercise device 5 includes the carriage return assembly 500 toward the inner sides 30, 50 (FIG. 1) of both end portions 20, 40. FIG. 18 illustrates an interface between the second end plate 115, the carriage return assembly 500 and the drive assembly 300 according to one embodiment of the present invention, viewing the second end portion 40 (FIG. 1) from the inner side 50. The carriage return assembly 500 includes a swing arm 505 pivotably mounted on each end plate 105 (FIG. 3), 115. The swing arm 505 may be fabricated from material such as metals, composites, and hardened plastics. The swing arm 505 of the embodiment illustrated in FIG. 18 is fabricated from a metal such as aluminum or steel plate.

Figure 19:
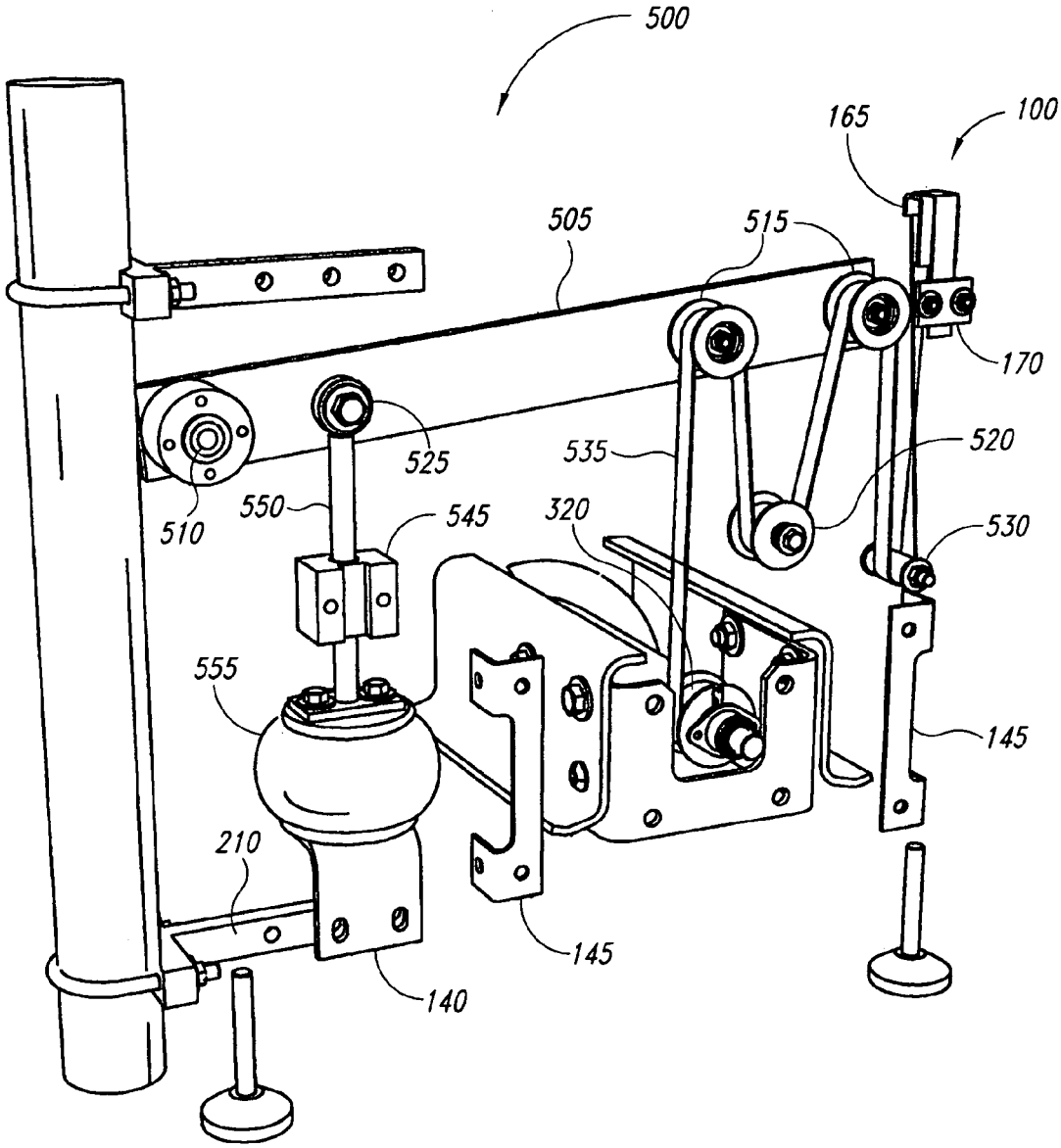
FIG. 19 is an isometric view of one of the end plate assemblies of the exercise device of FIG. 1.

As shown in FIG. 19, which is a view of the carriage return assembly 500 with the end plate 115 removed, the swing arm 505 is pivotably supported by a swing arm journal 510. The carriage return assembly 500 further includes two swing arm idler pulleys 515 rotatably mounted on each swing arm 505 and an end plate idler pulley 520 rotatably mounted on each end plate 105, 115. The carriage return assembly also comprises a stud 530 rigidly mounted on the end plates 105, 115 and a carriage return belt 535 that extends from the stud 530 around at least a portion of the idler pulleys 515, 520 and the torque tube pulley 320. The carriage return belt 535 can be fabricated from material such as, but not limited to, nylon, KEVLAR®, plastics, and/or synthetic or natural rubbers, or any material capable of withstanding tension loads associated with forces exerted by the user. The carriage return assembly 500 also includes a cam wheel 525, a shaft 550 and a biasing device 555, such as an air spring. When in use cam wheel 525 rotates atop shaft 550 compressing biasing device 555.

In operation, as illustrated in FIG. 3, a user drives one of the foot support members 670 in an outward direction 65 toward a lateral-most position 60. As discussed above in conjunction with FIGS. 13-15, driving the foot support members 670, 675 induces the torque tube drive wheel 630 to rotatably glide on the first surface of the helical fin 317, promoting the rotation of the torque tubes 310, 315.

Referring back to FIGS. 18 and 19, the rotation of the torque tubes 310, 315 induces a rotation of the torque tube pulley 320, gathering the carriage return belt 535 and pivoting the swing arm 505 about the swing arm journal 510. Pivoting of the swing arm 505 causes the shaft 550 to exert a compressive force on the biasing device 555. Embodiments in which the biasing device 555 is an air spring, driving the foot support members 670, 675 toward a lateral-most position 60 (FIG. 3) will compress the air spring 555. Furthermore, a shaft journal 545 may be incorporated to guide a motion of the shaft 550.

A biasing device support bracket 140, fixedly attached to each end plate 105, 115 as shown in FIG. 4, supports the biasing device 555. As illustrated in FIG. 19, the bracket 140 resists non-compressive displacement of the biasing device 555, allowing the biasing device 555 to build a potential to promote a return lateral motion of the foot support members 670, 675. Accordingly, as the user extends a lateral striding motion driving the foot support members 670, 675 to the lateral-most position 60 (FIG. 3), the compressed biasing device 555 reverses the motion, driving shaft 550 against the cam wheel 525. The cam wheel 525 thus biases the swing arm 505 to pivot in a reverse direction, unwrapping the carriage return belt 535 from the torque tube pulley 320 and freewheeling or overriding the torque tube 320 about drive shaft 350 (FIG. 7) to drive the foot support members 670, 675 inward with respect to the ends 20, 40 (FIG. 1).

In addition to, or instead of, securing the carriage return belt 535 about the stud 530, the carriage frame assembly 100 may also include a belt bracket 165 attaching a belt clamp plate 170 fabricated from a rigid material such as 10 or 12 gauge steel for clamping the carriage return belt 535 to the end plates 105, 115. Furthermore, to secure the first and second panels 150, 155 of the carriage frame assembly 100, the frame assembly 100 may further comprise at least one panel support bracket 145 attached via any suitable means such as fastening or welding, to the end plates 105, 115 and/or the main rails 125, 130 as depicted in FIG. 19.

For ease of construction and minimization of parts, the fastening means attaching the biasing device support brackets 140 can be in common with the same for attaching the main-rail saddle mounts 210 as shown in FIGS. 4 and 19. Additionally, it is understood that the carriage return assembly 500 can have means for deactivating the carriage return assembly, for example means for disconnecting the carriage return belt 535 from the torque tube pulley 320. Embodiments incorporating the latter feature may be desirable for user's who wish to drive the foot support members 670, 675 using their own force, for example for strengthening inner thigh muscles.

Figure 20:
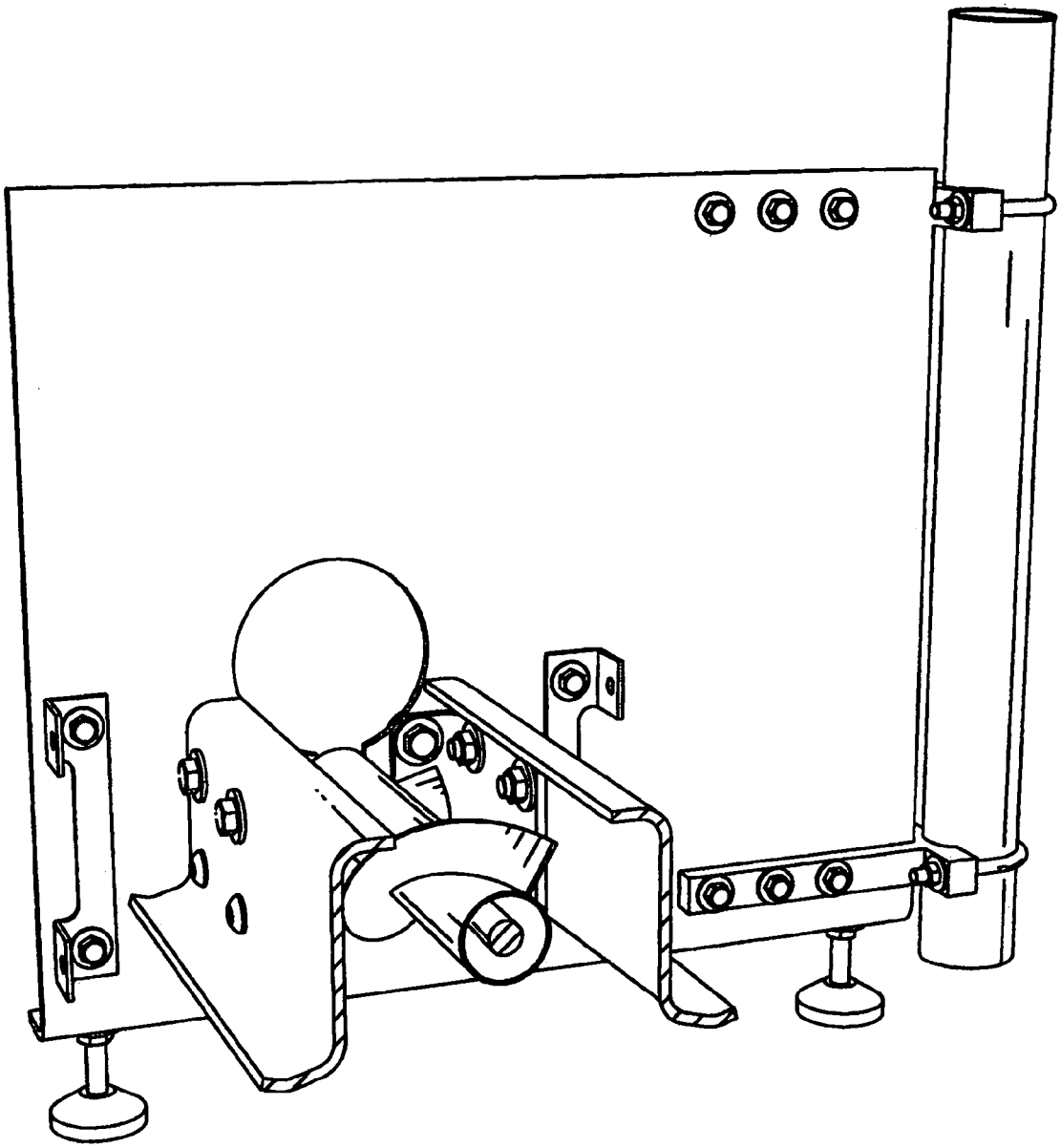
FIG. 20 is an isometric view of an end portion of an exercise device according to still another embodiment of the present invention.

Alternatively, an exercise device 5 according to another embodiment of the present invention as illustrated in FIG. 20, may exclude the carriage return assembly 500 altogether for the same reason. An individual of ordinary skill in the art having reviewed this disclosure will appreciate these and other modifications that can be made to the exercise device 5 and/or the carriage return assembly 500 without deviating from the spirit of the invention.

Figure 21:
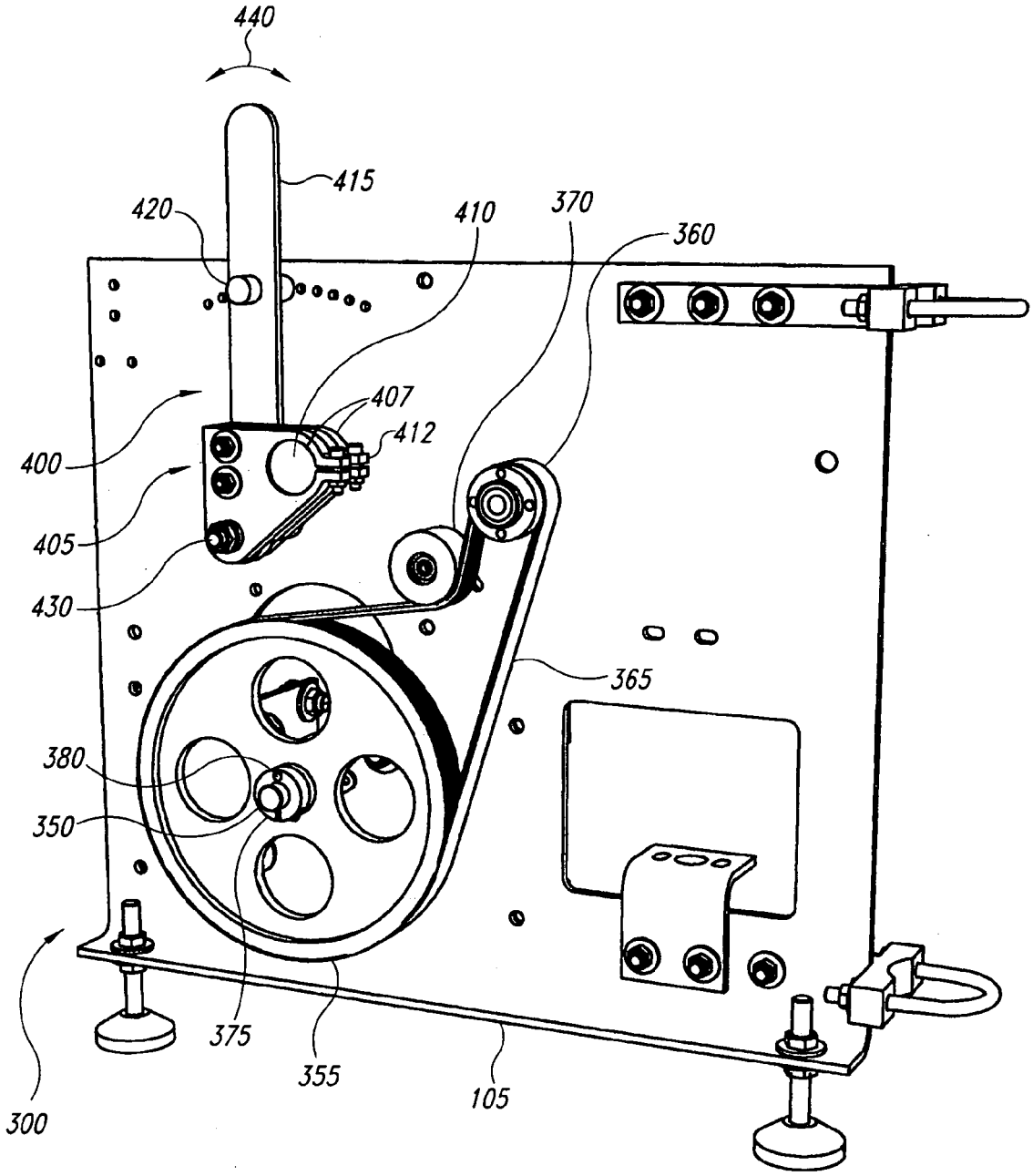
FIG. 21 is an isometric view of another end portion of the exercise device of FIG. 1.
Figure 22:
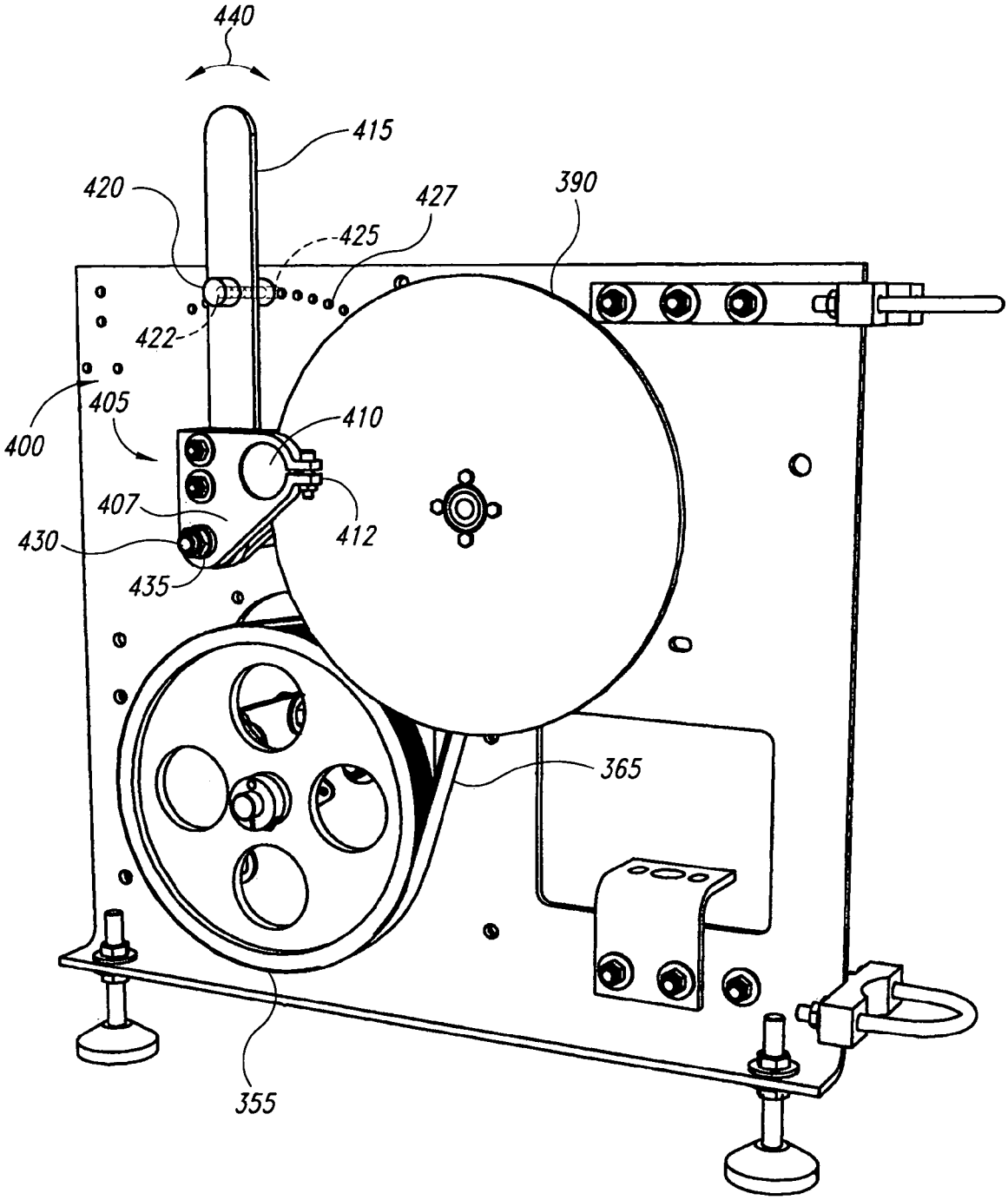
FIG. 22 is yet another isometric view of the end portion of the exercise device of FIG. 1.

FIGS. 21 and 22 illustrate portions of the resistance assembly 400 and drive assembly 300 of the exercise device 5 according to an embodiment of the present invention. As discussed in conjunction with FIGS. 6 and 8, the drive sheave 355 securely receives the drive shaft 350 toward the portion of the drive shaft 350 that protrudes beyond the first end plate 105. The drive shaft 350 is axially supported by the first drive shaft collar 375 and the roll pin 380 made from high strength material such as metals including steel, the roll pin 380 being driven through the first drive shaft collar 375 and the drive sheave 355, coinciding rotations of the drive shaft 350 and the drive sheave 355.

The drive assembly 300 further includes a driven sheave 360 fabricated from a material such as composites and/or metals such as aluminum, and rotatably mounted on the first end plate 105. A drive belt 365 extends between the drive sheave 355 and the driven sheave 360. An idler pulley 370 can also be rotatably mounted on the first end plate 105 for tensioning the drive belt 365. The drive belt 365 may be fabricated from material such as nylon, KEVLAR®, and/or synthetic or natural rubbers, or any material capable of withstanding tensions associated with resisting the drive assembly 300, such as a POLY-V™J-section drive belt. The drive assembly 300 also comprises a flywheel 390 (FIG. 22), which can be mounted on the driven sheave 360.

As illustrated in FIG. 22, the resistance assembly 400 includes a resistance frame 405 fabricated from material such as metals including aluminum plates and/or composites. The resistance frame 405 may include two plate members 407 having a breach or a gap therebetween. The plate members 407 are each adapted to secure a magnetic device 410 on and/or through a surface thereof using securing means such as clamp members 412. The resistance frame 405 is pivotably mounted, for example to the first end plate 105. As illustrated in FIG. 22, at least a portion of the flywheel 390 travels between the plate members 407 of the resistance frame 405.

As the flywheel 390 rotates between the magnetic devices 410 secured by the plate members 407, an eddy current is created, resisting the rotation of the flywheel 390. Resisting the rotation of the flywheel 390 also resists the rotation of the drive sheave 355 and the drive shaft 350 via the drive belt 365. The resistance assembly also includes a actuator 415 operable to pivot 440 the resistance assembly 400 about a resistance assembly shaft 430, varying the proximity of the magnetic devices 410 to the flywheel 390 and changing a magnitude of the eddy current created and thus the resistance on the drive shaft 350. The shaft 430 may include a resistance assembly shaft clamp collar 435 operable to center the frame 405 in relation to the flywheel 390.

The resistance assembly 400 may also include an adjusting mechanism 420 to maintain a desired position of the resistance frame 405 and a desired magnitude of the eddy current. The adjusting mechanism 420 may include a spring tube that comprises a spring ball 425 and a compression spring 422, the compression spring 422 forcing the spring ball 425 against the first end plate 105 and a resulting friction securing the resistance assembly 400 relative to the end plate 105. The end plate 105 may include a plurality of apertures 427, each correlating with a distinct magnitude of the eddy current and operable to receive at least a portion of the spring tube, such as at least a portion of the spring ball 425, to better secure the resistance frame 405 at the desired position.

Figure 23:
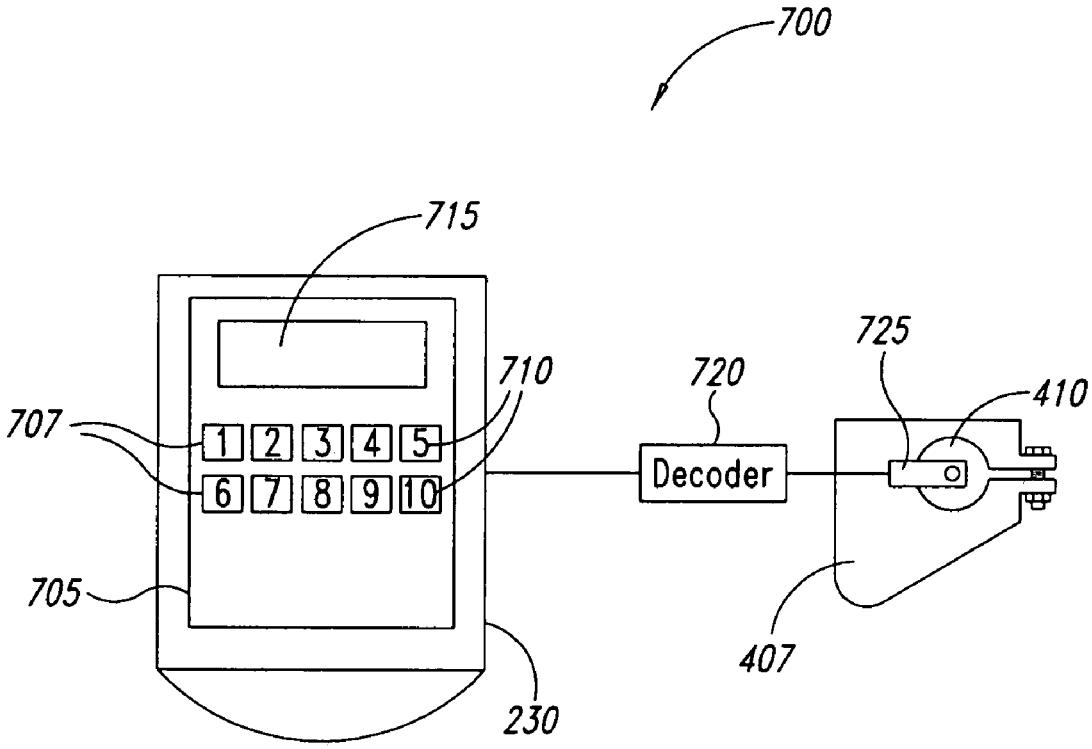
FIG. 23 is a block diagram schematically illustrating a control means for a resistance assembly of an exercise device according to a further embodiment of the present invention.

Additionally, or alternatively, as illustrated in FIG. 23, the panel 230 may include an eddy current control system 700 for selectively controlling the magnitude of the eddy current. The control system 700 may include a user interface 705 operable to communicate an indication of the magnitude of the eddy current to a decoder 720. The decoder 720 can be in electrical communication with the user interface 705 and operable to receive the indication and translate the indication to a dimension of the breach between the magnetic devices 410 mounted to the plate members 407 of the resistance frame 405.

A biasing device 725 can be in electrical communication with the decoder 720 and operable to displace the magnetic devices 410 and/or the plate members 407 to achieve the dimension of the breach between the magnetic devices 410 correlating with the indication of the magnitude of the eddy current. The user interface 705 may include a plurality of selection media 707 bearing indicia 710 correlating with the magnitude of the eddy current, the selection media 707 being selectable by the user to define the indication of the magnitude of the eddy current. The user interface 705 may further include a display device 715 operable to display the indicia 710.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. An exercise device comprising:

a frame transversely extending from a first lateral end to an opposing second lateral end, the frame being configured to be supported on a surface and having a central portion between the first and second lateral ends;

a pair of coaxial torque tubes transversely elongated end to end from a first lateral end, proximate the first lateral end of the frame, to an opposing second lateral end, proximate the second lateral end of the frame, the torque tubes being rotatably mounted to the frame, each of the torque tubes including a helical fin having a first surface and a second surface, opposing the first surface, the helical fin extending about a cylindrical surface of each of the torque tubes, the helical fin being continuous and rigidly fixed with respect to the cylindrical surface at least from proximate the central portion to proximate the first lateral end of one of the torque tubes and from proximate the central portion to proximate the second lateral end of the other of the torque tubes;

a first foot carriage assembly having at least one drive wheel rotatably coupled to a foot support member, the drive wheel being positioned on the first surface of the helical fin to allow transverse motion of the first foot carriage assembly between proximate the central portion and proximate the first lateral end of the frame, the one torque tube rotating when the drive wheel moves along the first surface of the helical fin; and a second foot carriage assembly having at least one drive wheel rotatably coupled to a foot support member, the drive wheel being positioned on the first surface of the helical fin to allow transverse motion of the second foot carriage assembly between proximate the central portion and proximate the second lateral end of the frame, the other torque tube rotating when the drive wheel moves along the first surface of the helical fin.

2. The exercise device according to claim 1, further comprising:

a first carriage return assembly comprising a first biasing member coupled to the first foot carriage assembly, the first biasing member substantially lacking a potential for biasing when the first foot carriage assembly is in the central portion, and the potential for biasing increasing as the first foot carriage assembly travels toward the first lateral end of the frame for configuring the first biasing member to bias the first foot carriage assembly toward the central portion; and a second carriage return assembly comprising a second biasing member coupled to the second foot carriage assembly, the second biasing member substantially lacking a potential for biasing when the second foot carriage assembly is in the central portion, and the potential for biasing increasing as the second foot carriage assembly travels toward the first lateral end of the frame for configuring the second biasing member to bias the second foot carriage assembly toward the central portion.

3. The exercise device according to claim 1 wherein the frame includes at least one rail extending between the first and second lateral ends of the frame, and the first and second foot carriage assemblies each include at least one carriage wheel rotatably coupled to the corresponding foot support member and drivingly engaging the at least one rail, respectively.

4. The exercise device according to claim 1 wherein the torque tubes are concentrically mounted onto, and configured to rotate with, a drive shaft rotatably mounted to the frame, an end of the one torque tube proximate the central portion being spaced from an adjacent end of the other torque tube proximate the central portion for preventing each of the first and second foot carriage assemblies from traveling beyond the central portion toward the other of the first and second foot carriage assemblies.

5. The exercise device according to claim 1 wherein the first and second foot carriage assemblies respectively further comprise:

at least one return wheel rotatably coupled to the foot support member and operable to drive along the second surface of the helical fin.

6. The exercise device according to claim 1, further comprising:

at least one carriage return assembly having a pulley system in mechanical communication with a biasing device and the torque tubes to promote a return of the first and second foot carriage assemblies toward the central portion.

7. The exercise device according to claim 1, further comprising:

a flywheel rigidly mounted toward the first or second lateral end of the torque tubes and configured to rotate therewith; and at least one magnetic device configured to create an eddy current for resisting a rotation of the flywheel, a magnitude of the eddy current depending on a distance between the magnetic device and the flywheel, the distance being selectively controllable, for varying a resistance of the flywheel and the torque tubes against the rotation thereof.

8. The exercise device according to claim 7, further comprising:

an actuator coupled to the magnetic device, the actuator being adjustable between a plurality of positions, each position being configured to locate the magnetic device at a distinct distance with respect to the flywheel.

9. The exercise device according to claim 8, wherein the frame further comprises:

a handrail extending between the first and second lateral ends of the frame; and control means mechanically coupled to the handrail and electronically coupled to the actuator for selectively controlling the magnitude of the eddy current.

10. The exercise device according to claim 9 wherein the control means comprises a panel mounted to the main handrail and having a user interface operable to communicate an indication of the eddy current and a decoder in electrical communication with the user interface and operable to receive the indication and translate the indication to a proximity of the magnetic device to the flywheel, and the actuator comprises a biasing device in electrical communication with the decoder and operable to displace the at least one magnetic device to achieve the proximity of the magnetic device to the flywheel correlating with the indication of the eddy current.

11. The exercise device according to claim 10, wherein the user interface comprises:

a plurality of selection media bearing indicia correlating with the magnitude of the eddy current, the selection media being selectable by a user to define the indication of the magnitude of the eddy current; and a display device operable to display the indicia selected by the user, correlating with the indication of the magnitude of the eddy current.

* * * * *